US008468964B2

(12) United States Patent
Hoberman et al.

(10) Patent No.: US 8,468,964 B2
(45) Date of Patent: Jun. 25, 2013

(54) METHODS AND ARRANGEMENTS FOR REDIRECTING THRUST FROM A PROPELLER

(76) Inventors: Kevin Daniel Hoberman, Tarzana, CA (US); Steven Clay Moore, Austin, TX (US)

( * ) Notice: Subject to any disclaimer, the term of this patent is extended or adjusted under 35 U.S.C. 154(b) by 874 days.

(21) Appl. No.: 11/224,762

(22) Filed: Sep. 13, 2005

(65) Prior Publication Data

US 2006/0054067 A1 Mar. 16, 2006

Related U.S. Application Data

(60) Provisional application No. 60/609,717, filed on Sep. 14, 2004.

(51) Int. Cl.

| | |
|---|---|
| ***B63H 5/125*** | (2006.01) |
| ***B63H 5/16*** | (2006.01) |
| ***B63H 20/00*** | (2006.01) |
| ***B63H 25/00*** | (2006.01) |
| ***B63H 25/44*** | (2006.01) |
| ***B63H 25/48*** | (2006.01) |

(52) U.S. Cl.
USPC ..... 114/144 R; 114/145 R; 440/63; 440/70

(58) Field of Classification Search
USPC 114/145 R, 145 A, 162, 163, 144 RE–144 E, 114/144 R; 440/440, 40–43, 63, 66–70; 701/21
See application file for complete search history.

(56) References Cited

U.S. PATENT DOCUMENTS

| | | | | | |
|---|---|---|---|---|---|
| 1,500,584 | A | * | 7/1924 | Harley | 114/145 R |
| 1,543,082 | A | * | 6/1925 | Harley | 440/63 |
| 2,050,336 | A | * | 8/1936 | Karsinski | 415/8 |
| 2,751,875 | A | * | 6/1956 | Henry | 415/8 |
| 2,856,883 | A | * | 10/1958 | Baker | 440/56 |
| 2,916,005 | A | * | 12/1959 | Parsons | 114/145 R |
| 2,961,988 | A | * | 11/1960 | Wood | 440/65 |
| 3,384,045 | A | * | 5/1968 | Lusby | 114/145 R |
| 3,603,277 | A | * | 9/1971 | Manary et al. | 114/145 A |
| 4,026,231 | A | * | 5/1977 | Fedorko | 114/145 A |
| 4,237,808 | A | * | 12/1980 | Doerffer | 114/170 |
| 4,549,498 | A | * | 10/1985 | Meyer et al. | 114/145 A |
| 4,895,093 | A | * | 1/1990 | Dalsbo | 114/163 |
| 5,154,650 | A | * | 10/1992 | Nakase | 440/41 |
| 5,713,770 | A | * | 2/1998 | Ambli | 440/41 |

* cited by examiner

*Primary Examiner* — Ajay Vasudeva
(74) *Attorney, Agent, or Firm* — Schubert Law Group PLLC

(57) ABSTRACT

Methods and arrangements to redirect a forward thrust generated by a propeller of a watercraft to provide a non-forward thrust are disclosed. More specifically, embodiments comprise a control surface to redirect the forward thrust from the propeller. Based upon a position (i.e., distance and orientation) of the control surface with respect to the propeller, the redirection generates the non-forward thrust or thrusts. By redirecting a component of the forward thrust back toward the bow, the net forward or reverse, port or starboard thrusts and rotational thrust can be adjusted in fine increments. For instance, by adjusting the amount of prop wash hitting the control surface, the magnitude of the redirected thrust from the control surface can be adjusted. Further, adjusting the angle of the control surfaces adjusts the direction as well as magnitude of a reverse thrust component. The net thrust can be in any direction and rotational.

49 Claims, 33 Drawing Sheets

100

ELECTRIC SYSTEM

PNEUMATIC SYSTEM

HYDRAULIC SYSTEM

1540

PROPULSION DATA

| NET THRUST DIRECTED AT CONTROL SURFACE | ANGLE OF CONTROL SURFACE | REDIRECTED THRUST COMPONENTS | HULL DESIGN | WEIGHT |
|---|---|---|---|---|
| | | | | |

PLATE ADJUSTMENT FORMULAS

| BEST GUESS ANGLE FOR DESIRED MOTION AND INTERPOLATOR | FORMULA FOR DETERMINING BEST GUESS ANGLE | CURVE FITTING ALGORITHIM(S) |
|---|---|---|
| USES PROVIDED DATA AND AN INTERPOLATION FOR IN BETWEEN VALUES | PROVIDES FORMULAS FOR RANGES OF VALUES | BUILDS FORMULA BASED UPON AVAILABLE INFORMATION |

1550

FIG 15B

METHODS AND ARRANGEMENTS FOR REDIRECTING THRUST FROM A PROPELLER

CROSS-REFERENCES TO RELATED APPLICATIONS

Pursuant to 35 USC §119(e), this application claims priority to and benefit of U.S. Provisional Patent Application Ser. No. 60/609,717, filed Sep. 14, 2004.

FIELD OF INVENTION

The present invention is in the field of thrust control for propeller driven watercraft such as a boat. More particularly, the present invention relates to methods and arrangements to redirect a thrust generated by a propeller via a control surface for a watercraft to provide a non-forward thrust. Many such embodiments may advantageously provide finer and/or quicker adjustments to the net thrust, steering, wake control, tilt control and/or other control via the redirected thrust.

BACKGROUND

The watercraft designs differ the size, shape, and propulsion of the watercrafts. For instance, contemporary watercraft designs implement sails, jet engines, fans, water-jet propulsion drives, paddle drives, and motor-driven propellers for propulsion. Each type of propulsion has unique advantages and disadvantages.

People use watercrafts for a variety of recreational and commercial activities, from pulling water skiers to transporting oil to racing. The large variety of uses for watercrafts have inspired specialized and general purpose designs of various sizes, shapes, and means of propulsion; including propeller driven motorized versions; which are generally available as an inboard, outboard or inboard-outboard. Watercrafts with inboard drives ("inboards") typically have a motor mounted in the watercraft and a fixed-position propeller. Inboards are inherently simpler designs than watercrafts with outboard motor drives ("outboards") or watercrafts with inboard-outboard drives ("IOs"), or stern drives, so they are usually lower cost and lower maintenance. Inboards typically include a rudder in the prop wash of the propeller to steer the watercraft. Placing the rudder in the prop wash improves the steering by increasing the amount of water being redirected by the rudder. In reverse, the rudder is not in the prop wash and, as a result, the inboards are difficult to maneuver in reverse, which is especially troublesome when attempting to maneuver the watercraft to a dock, onto a trailer or when preparing to pull a water skier.

Large watercrafts such as boats that are greater than 30 meters in length are typically inboards due to the cost and maintenance advantages of inboards. Unlike smaller boats such as boats that are about 3 to 8 meters in length, the added cost and weight to mount side thrusters is less significant for large boats.

Outboards have one or more outboard motors mounted at the stern of the boat. A motor is located at the top of the outboard drive and is connected to a propeller at the bottom of the drive via a transmission and a substantially vertical shaft.

In many outboard designs, the outboard drive may rotate approximately 110 degrees in the horizontal plane, depending upon the design, to provide steering and can be tilted vertically to raise the propeller above the bottom of the hull to protect the propeller when the watercraft is in shallow water or transported or stored out of water. Because outboard drives typically have only one reverse, and one forward gear, the gear may provide too much thrust even in idle to easily dock the boat, which forces the person docking the boat to repeatedly switch between in gear and neutral to achieve slower speeds than possible at idle. Also, when maneuvering to remove slack in a ski rope, idle speed is typically too fast.

IOs have stern drives, which locate the motor inside the boat at the stern. The motor is connected through the transom to an outboard drive unit similar to the bottom half of an outboard motor. IOs provide steering by allowing the outboard drive unit to pivot about a substantially vertical axis. IOs are far more popular than standard inboards partly because they are easier to steer, especially in reverse. Yet, idle speed in both forward and reverse is typically too fast for docking and for removing slack in a ski rope.

SUMMARY OF THE INVENTION

The problems identified above are in large part addressed by methods and arrangements to redirect thrust generated by a propeller of a watercraft to provide a reverse and/or sideways thrust. One embodiment provides an apparatus to redirect a thrust generated by a propeller for a watercraft. The apparatus may comprise a control surface to redirect the thrust from the propeller based upon a position of the control surface with respect to the propeller, wherein the redirected thrust comprises a component of non-forward thrust; and a first member to couple with the watercraft to apply force to adjust a spatial relationship between the control surface and the propeller to position the control surface at least partially within an area in which prop wash is to be expelled by the propeller.

One embodiment provides a method for a watercraft to redirect a thrust generated by a propeller via a plate. The method generally involves applying force via a first member to adjust a spatial relationship between the control surface and the propeller to position the control surface at least partially within an area in which prop wash is to be expelled by the propeller; and redirecting the thrust from the propeller via the control surface based upon the spatial relationship of the control surface with respect to the propeller, wherein the redirected thrust comprises a component of non-forward thrust.

Another embodiment provides a watercraft capable of redirecting a thrust generated by a propeller. The watercraft may comprise a hull having a motor coupled with the propeller to rotate the propeller to expel prop wash to generate the thrust; a control surface to redirect the thrust from the propeller, based upon a position of the control surface with respect to the propeller, wherein the redirected thrust comprises a component of non-forward thrust; and a first member to couple with the hull to apply force to adjust a spatial relationship between the control surface and the propeller to position the control surface at least partially within the prop wash.

A further embodiment provides a retrofit kit for a watercraft to redirect a thrust generated by a propeller. The retrofit kit may comprise a rigid member to couple with the watercraft; a non-rigid joint to couple with the rigid member; and a control surface to couple with the rigid member via the non-rigid joint to restrict movement of the control surface in at least one direction and to apply force to the control surface to position the control surface in water within an area in which prop wash is to be expelled by the propeller to reflect the thrust in response to generation of the thrust by the propeller, based upon a position of the control surface with respect to the propeller, to redirect the thrust, wherein the redirected thrust comprises a component of non-forward thrust.

A further embodiment provides a controller to redirect a thrust generated by a propeller via a plate for a watercraft. The controller may comprise a sensor to detect the position of the control surface, a memory to store a current position of the control surface with respect to the propeller; logic coupled with the other controller elements to determine an adjustment for a spatial relationship between the control surface and the propeller based upon the current position; and a driver interface to instruct a driver to adjust the spatial relationship between the control surface and the propeller to position the control surface at least partially within prop wash of the propeller to redirect the thrust, wherein redirection of the thrust by the control surface produces a component of non-forward thrust.

Yet another embodiment provides a control system for a watercraft to redirect a thrust generated by a propeller. The control system may comprise a control surface to redirect the thrust from the propeller based upon a position of the control surface with respect to the propeller, wherein the redirected thrust comprises a component of non-forward thrust; an attachment member coupled with the watercraft to apply force to modify the spatial relationship between the control surface and the propeller to position the control surface at least partially within an area in which prop wash is to be expelled by the propeller; a driver to transmit the force from the watercraft to the attachment member; and a controller to determine an adjustment for the spatial relationship between the control surface and the propeller and the communication with the driver to implement the adjustment.

A further embodiment provides a machine-accessible medium containing instructions to redirect a thrust generated by a propeller via a control surface for a watercraft, which when the instructions are executed by a machine, cause said machine to perform operations. The operations may comprise applying force to position the control surface in water within an area in which prop wash is expelled by the propeller; and redirecting said thrust via the control surface based upon a position of the control surface with respect to the propeller, wherein the redirected thrust comprises a component of non-forward thrust.

A still further embodiment provides a database to redirect a thrust generated by a propeller via a plate for a watercraft. The database may comprise thrust data to relate a current spatial relationship between the control surface and the propeller with a component of a current redirected thrust; data to relate the components of the current redirected thrust and/or boat angular and rotational velocity with a operator specified propulsion of the watercraft; and a formula to determine an adjustment to the spatial relationship based upon a difference between the current redirected thrust and a new propulsion, the adjustment to position the control surface at least partially within an area in which prop wash is to be expelled by the propeller to effect the new propulsion; wherein the adjustment is indicative of an application of force to implement the adjustment.

BRIEF DESCRIPTION OF THE DRAWINGS

Other objects and advantages of the invention will become apparent upon reading the following detailed description and upon reference to the accompanying drawings in which, like references may indicate similar elements:

FIGS. 15A-B depicts an embodiment of a data structure to redirect a thrust generated by a propeller via a control surface for a watercraft;

DETAILED DESCRIPTION OF EMBODIMENTS

Figure 1A:
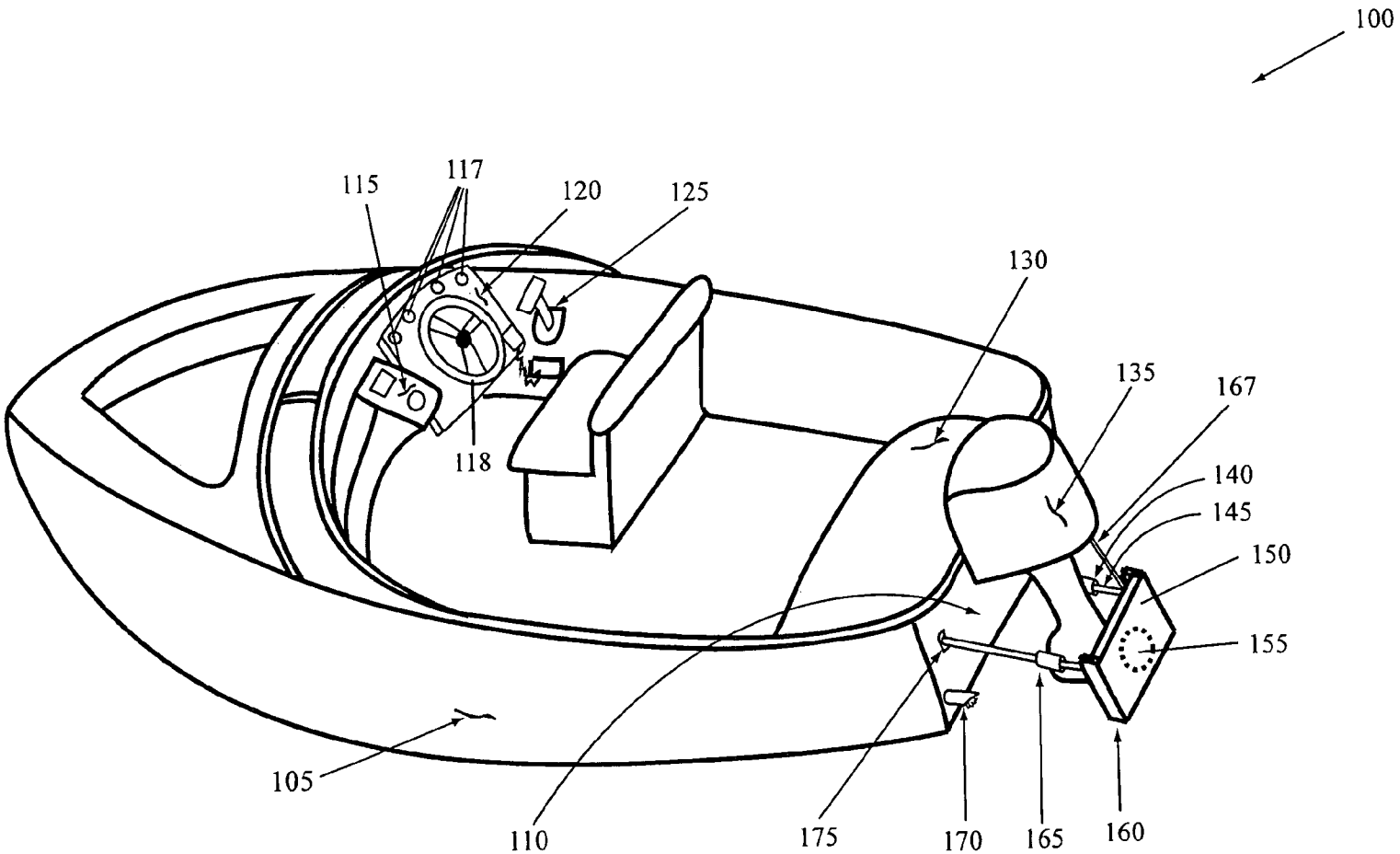
FIGS. 1A-F depicts an embodiment of a watercraft (an outboard in this embodiment), to redirect a forward thrust generated by a propeller of boat to provide a reverse thrust and various leveling situations and schemes for the boat in FIG. 1A.

The following is a detailed description of example embodiments of the invention depicted in the accompanying drawings. The example embodiments are in such detail as to clearly communicate the invention. However, the amount of detail offered is not intended to limit the anticipated variations of embodiments, but on the contrary, the intention is to cover all modifications, equivalents, and alternatives falling within the spirit and scope of the present invention as defined by the appended claims. The detailed descriptions below are designed to make many such embodiments obvious to a person of ordinary skill in the art.

Introduction

Generally speaking, methods and arrangements to redirect a thrust generated by a propeller of a watercraft to provide a non-forward thrust are disclosed. More specifically, embodiments comprise a control surface such as a plate to redirect the thrust in response to generation of the thrust by the propeller. Based upon a position (i.e., distance and orientation) of the control surface with respect to the propeller, the redirection generates at least a component of non-forward thrust. By redirecting a component of the thrust back toward the propeller, the propulsion of the watercraft is the net effect of all the thrusts so the net forward or reverse and port or starboard thrusts can be adjusted in fine increments. The granularity of the adjustments is related to the increments in adjustment of the spatial relationship between the propeller and the control surface. For instance, by adjusting the distance between the control surface and the propeller, the magnitude of the thrust that impacts the control surface can be adjusted. Therefore, in such embodiments, the net thrust can be adjusted in increments related to the smallest distance that, e.g., the control surface can be moved away from the propeller.

By redirecting most or all of the thrust back toward the propeller, some embodiments may advantageously be capable of reverse propulsion (as well as forward propulsion) without a reverse gear or with no transmission at all, reducing manufacturing and maintenance. Note that the reverse propulsion generated by, e.g., positioning the control surface in the prop wash of the propeller or orienting the propeller to direct the thrust toward the control surface while the propeller is generating a forward thrust, can advantageously provide a significant braking action for the watercraft without damaging the gears. Transmissions of contemporary watercraft provide a reverse gear but shifting the transmission into a reverse gear while at greater than idle speed or RPM may damage a transmission. In embodiments of the present invention the control surface may be attached or integrated into the hull of the watercraft in a manner that can handle the forces involved with the abrupt transition from forward thrust to reverse thrust at high speeds. Thus, some embodiments of the invention offer significantly enhanced safety and acceleration by allowing the boat operator to transition quickly between a full-throttle, forward, reverse or, neutral thrust. Accordingly, some embodiments may also comprise safety belts or similar restraints for passengers and/or cargo. Further embodiments implement a speed or RPM limitation on shifting thrust direction positions.

Many embodiments facilitate adjustment of the angle of the control surface with respect to the propeller, which changes the angle of incidence of the prop wash on the control surface. Adjusting the angle of incidence of the prop wash on the control surface adjusts the direction and magnitude of the component of non-forward thrust with or without significantly changing the distance between the plate and the propeller. Several embodiments facilitate both adjustments to the distance between the control surface and the propeller as well as adjustments to the angle of incidence of the thrust on the control surface, advantageously providing the watercraft operator with the ability to simultaneously, independently, and incrementally adjust magnitude and direction of redirection of redirected thrust. Other embodiments adjust the amount of prop wash that impinges upon the control surface for control of forward/reverse thrust while independently adjusting the angle of impingement to adjust the direction of redirected thrust. Other embodiments transition from no redirection of prop wash through upward or downward redirection of prop wash which has no steering effect to redirection of prop wash while independently controlling the magnitude of port or starboard redirection of prop wash.

Further, the net thrust may be directed forward, backward, to port, to starboard, or any other direction, depending upon the adjustability of the angle of the control surface with respect to the propeller and the propeller with respect to the watercraft. For example, embodiments that adjust the angle of the control surface may redirect a component of the thrust in a direction other than back toward the bow. In such embodiments, the control surface may be angled to redirect a component of the forward thrust to port to turn the watercraft to the starboard or vice versa. Redirecting the forward thrust or a portion thereof sideways, the watercraft may advantageously turn at, e.g., one-fifth the turning radius of the watercraft without utilizing the control surface. It may even rotate in place.

If a component of the thrust is directed downward, the stern of the watercraft may be raised. Similarly, if a component of the thrust is redirected upward, the stern may be lowered, possibly to change the size of the wake created by the watercraft.

Some of these embodiments comprise a controller designed to take advantage of the fine adjustments to control the speed of the watercraft, generate a wake of a desired shape, maintain the watercraft substantially level, enhance steering capabilities of the watercraft, or any other application for the redirected thrust. For example, one embodiment includes two plates. The angle of the plates may be controlled independently to allow one component of thrust to be redirected upward, and another component to be redirected downward, in addition to the reverse thrust component. Adjustment of net thrust whether forward or reverse may provide speed control while the net of the upward and downward thrusts may provide control over the bow-to-stern angle of the watercraft. Other embodiments comprise more or less than two control surfaces and some embodiments pivot control surfaces along different axes such as port-to-starboard rather than or in addition to pivoting upward and downward. In further embodiments, control surfaces are fixed or substantially fixed and the propeller is moved to adjust the magnitude and the angle of impact of thrust on the control surfaces. In alternative embodiments, the propeller moves up/down to control the ratio of forward to reverse thrust and the control surface(s) are rotated about a substantially vertical axis or moved port to starboard to independently control steering.

Some embodiments may comprise a database with data and/or formulas to facilitate adjustments by the controller responsive to instructions from the watercraft operator. Further embodiments comprise one or more sensors adapted to provide the controller with data to determine adjustments for the control surface. For example, several embodiments may comprise a pressure sensor coupled with the control surface, a global positioning system (GPS), and/or a speedometer such as a paddle type speedometer. The controller in such embodiments may then be able to navigate the watercraft between destinations. In one such embodiment, the controller is adapted to help the boat operator execute a complex set of maneuvers by adjusting the speed of the boat and helping the boat operator steer the watercraft in the desired direction. In particular, the route may be preprogrammed and stored in the controller so the controller may predict, at least approximately, when certain maneuvers should be executed. Thus, the controller can either predict maneuvers or be responsive to the boat operator's initiation of a maneuver.

While portions of the following detailed discussion describe embodiments of the invention in specific types of watercraft with particular types of instruments, sensors, numbers of control surfaces, shapes of control surfaces, and other equipment, embodiments with other watercraft and/or arrangements of equipment that comprise a submersed propeller to generate a thrust are also contemplated.

Watercraft and Outboards

Turning now to the drawings, FIG. 1A depicts an embodiment of an outboard motor boat 100, to redirect a thrust generated by a propeller 155 of boat 100 to provide a non-forward thrust. Boat 100 comprises a controller 115 adapted to redirect thrust generated by propeller 155. For example, an operator of boat 100 may adjust the angle of a control surface 150 with respect to propeller 155 to adjust, e.g., the net reverse thrust generated by boat 100. Adjustment of the net reverse thrust may accommodate fine and/or quick adjustments to the position of boat 100.

Boat 100 comprises a hull 105 with a transom 110, controller 115, a steering and instrument panel 120, a throttle control 125, a driver cabinet 130, motor 135, control surface 150, and propeller 155. Controller 115 comprises an interface for the boat operator to move or reorient control surface 150 to adjust the position of control surface 150 with respect to the thrust generated by propeller 155. In the present embodiment, controller 115 comprises a processor-based controller adapted to adjust the position of control surface 150 based upon input from the boat operator and from sensors on the boat such as speed sensor 170. In other embodiments, controller 115 may provide manual control of the position of control surface 150 and, in some of these embodiments, the manual control may be power-assisted via, e.g., a hydraulic system.

Controller 115 may facilitate adjustment of the angle of control surface 150 with respect to thrust generated via propeller 155 and/or adjustment of the distance between control surface 150 and propeller 155. And/or adjustment of amount of control surface in prop wash. Several embodiments adjust the angle of control surface 150 with respect to the thrust generated by propeller 155. Adjusting the angle of control surface 150 adjusts the magnitude of the component of thrust redirected back toward propeller 155.

When adjusting the net thrust by modifying the angle of control surface 150, a second component of the thrust may be redirected in a direction other than back toward propeller the bow of boat 105. The second component of the redirected thrust may advantageously be redirected in a way to enhance maneuverability, leveling, or the like of boat 100. For instance, when turning to port, control surface 150 may be angled to redirect a component of the thrust to port, enhancing the ability of boat 100 to turn to port. In some actual experiments, one embodiment allowed a boat to turn in place.

As another illustration, the redirected thrust reflected by control surface 150 may maintain the level of boat 100. The current embodiment utilizes one control surface that is a plate. The plate can redirect a component, e.g., in one general direction to raise the stern and/or raise the port side of boat 100, or to lower the stern and/or lower the starboard side of boat 100. In other embodiments, additional control surfaces may be implemented to increase the flexibility of adjustments. For instance, when the boat operator does not want to affect the port-to-starboard level of boat 100 while turning, controller 115 may redirect one component of the thrust upward and one component of the thrust downward to maintain the port-to-starboard level.

Watercraft Angles and Leveling

Figure 1C:
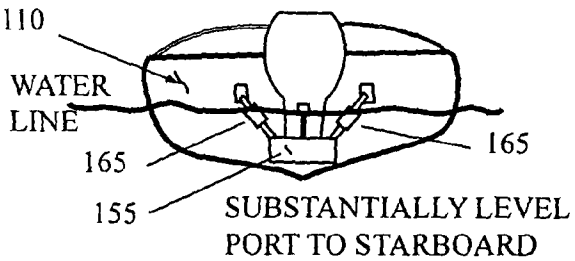
Figure 1E:
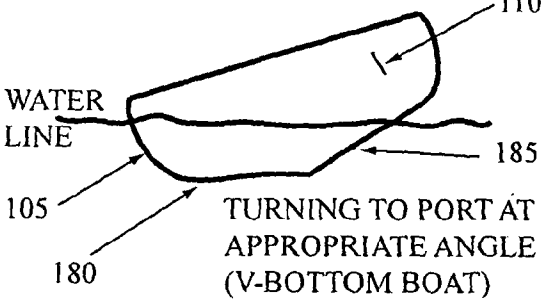
Figure 1F:
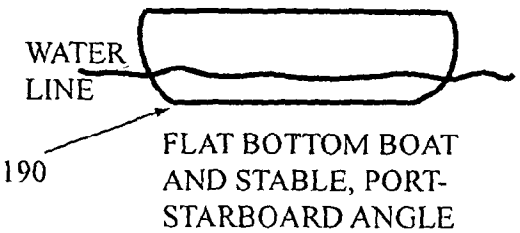
Figure 1B:
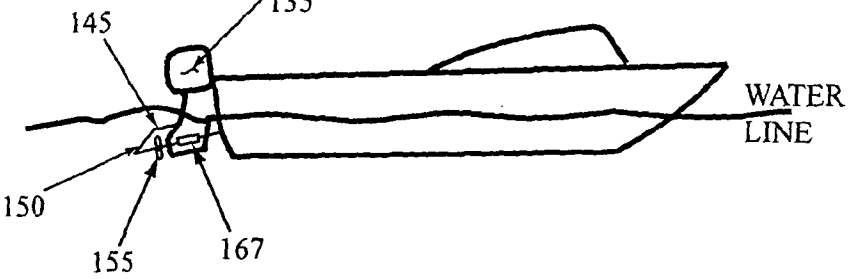
Figure 1D:
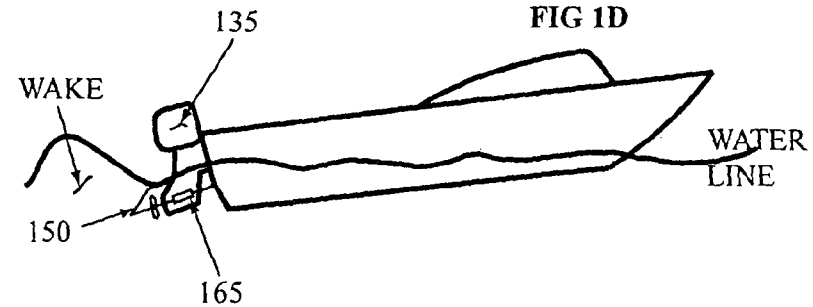

FIGS. 1B-F illustrate different various leveling situations and schemes for boat 100. Depending upon the boat operator's preference for the particular situation, the boat operator may want to maintain the bow-to-stern angle of boat 100 level as depicted in FIG. 1B, maintain the port-to-starboard angle of boat 100 level as depicted in FIGS. 1C and 1F, lower the stern of boat 100 as depicted in FIG. 1D, and/or lean boat 100 to port (or to starboard) as depicted in FIG. 1E.

Looking to FIGS. 1B-C, there are shown a side view of boat 100 and a rear view of boat 100 when the bow-to-stern ("trim") and port-to-starboard ("tilt") angles of boat 100 are substantially parallel with the water line. Adjustment of trim affects efficiency and smoothness of ride. Adjustment of tilt can improve safety and comfort.

Boat 100 comprises arms 145, 165 and 167 to apply force to control surface 150 to maintain the position of control surface 150. In the present embodiment, arms 165 and 167 are hydraulically adjustable via controller 115 (shown in FIG. 1A). In many embodiments, controller 115 is adapted to maintain the last position of the control surface 150 per instructions of the boat operator. In some of these embodiments, the boat operator may also program controller 115 to change the position of control surface 150 in response to certain conditions such as changes in the speed of boat 100, changes in the net pressure on control surface 150 from thrust and, e.g., water currents, or other factors that may be sensed by sensors of boat 100. In further embodiments, controller 115 may be programmed to dynamically adjust the position of control surface 150 to maintain, e.g., the level of boat 100 substantially parallel with the water line.

Controller 115 may maintain the level of boat 100 by adjusting the magnitude of components of redirected thrust to dynamically compensate for changes in one or more angle(s) of boat 100. For instance, boat 100 may comprise level sensors for the port-to-starboard angle, bow-to-stern angle and possibly other angles. In some embodiments, these sensors are combined in one or more gyroscope-based sensors. Controller 115 may detect changes in the level of boat 100 based upon data collected by the sensors and change the angle of control surface 150 to redirect a component of thrust in a direction determined to compensate for the change in the angle of boat 100.

In further embodiments, controller 115 may ignore or disregard low frequency changes in angles of boat 100 such as the bow-to-stern angle and may only compensate for higher frequency changes. For instance, repetitive lower frequency changes in the bow-to-stern angle of boat 100 may be indicative of large waves with respect to the size of boat 100 so compensating for the angle changes based upon such low frequency changes may be counter-productive with regard to propulsion. In many embodiments, the threshold between high frequency changes and low frequency changes may be programmable and/or pre-set.

FIGS. 1D-E illustrate a couple other example situations in which the boat operator may want controller 115 to ignore the tilt of boat 100 at certain angles in specific situations and/or to maintain angles other than angles parallel with the water line. FIG. 1D shows boat 100 with control surface 150 angled to redirect a component of thrust upward. Depending upon the size of control surface 150 with respect to propeller 155, control surface 150 may be also realize a water pressure resulting from the forward motion of boat 100 in relatively still water. The upward component of the redirected thrust lowers the stern of boat 100 lower into the water to generate a larger wake for, e.g., wake boarders and/or water skiers.

FIG. 1E shows an alternate hull configuration for boat 100. Hull 100 comprises a v-shaped bottom with a port bottom surface 180 and a starboard side bottom surface 185.

FIG. 1F shows an alternate hull configuration for boat 100. In FIG. 1F, the hull of the boat has a flat bottom 190 so the appropriate angle for the boat is with the flat bottom 190 substantially parallel to the water line. In such embodiments, controller 115 may be adapted to maintain the boat with a port-to-starboard angle substantially parallel with the water line.

In some embodiments, rather than or in addition to modifying the angle of control surface 150, the boat operator may modify the distance of control surface 150 from propeller 155 to adjust the magnitude of components of redirected thrust. Such embodiments adjust the magnitude of the thrust impacting control surface 150 because an increase in the distance between control surface 150 and propeller 155 decreases the amount of thrust reversal.

Referring back to FIG. 1A, steering and instrument panel 120 may comprise instruments 117, a steering wheel 118, and possibly other devices. Instruments 117 may provide analog and/or digital indicators linked with sensors such as a tachometer, a speedometer, a pressure gauge for a hydraulic or pneumatic system, a motor temperature gauge, a fuel gauge and/or other sensors that may provide useful information to the boat operator. In some embodiments, controller 115 may provide the digital and/or analog information in place of or in addition to instruments 117. In the present embodiment, controller 115 couples with a speed sensor 170 to monitor the speed of boat 100.

Speed sensor 170 is a paddle-type sensor that comprises a paddle wheel partially submerged in the water. As boat 100 moves forward or backwards, the paddle wheel spins due to pressure by the passing water at a rate. In many embodiments, controller 115 couples with speed sensor 170 to monitor the speed of boat 100.

Throttle control 125, FIG. 1A is adapted to adjust the throttle of motor 135, which adjusts the revolutions per minute (RPM) of propeller 155 subject to the load imposed by the water. Throttle control 125 may be a mechanical connection, adjusting the throttle via one or more cables, an electronic connection, or other. In many embodiments, electronic throttle controls provide a simple interface for coupling controller 115 to the throttle. For example, controller 115 may be adapted to adjust the throttle to some degree to automatically maintain boat speed, which may adjust the control surface 150 to effect changes in the speed. In several embodiments, controller 115 may offer control over the throttle for motor 135 via a hydraulic system, pneumatic system, solenoid, electric motor, fiber optic signals, or other control schemes.

In some embodiments, control over the position of control surface 150 may be power-assisted utilizing the same hydraulic or other power system which controls trim adjust that some boats have. In other embodiments, a separate system may be provided to adjust the position of control surface 150.

Figure 2A:
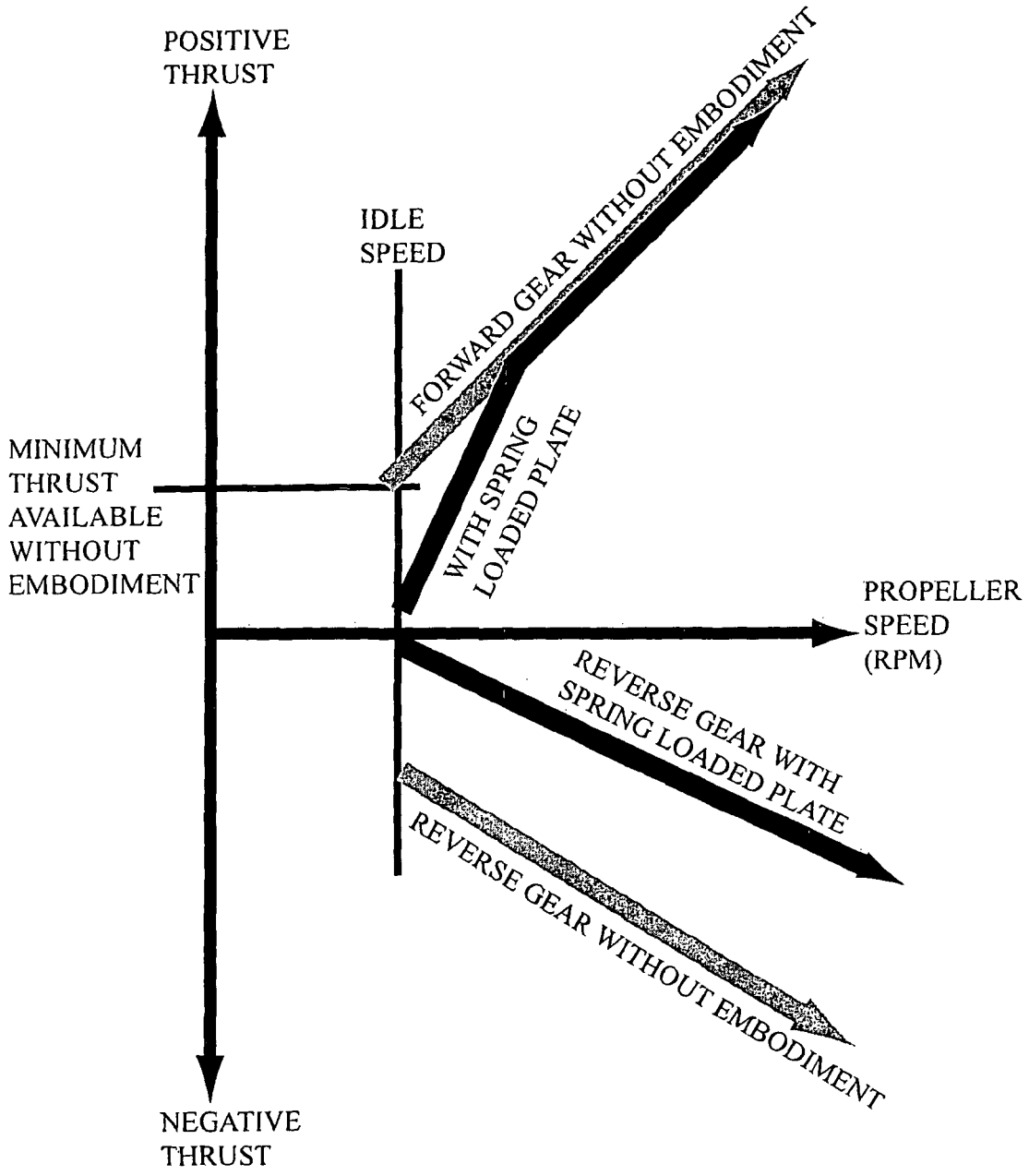
FIGS. 2A-B depict graphs for an embodiment comprising a spring-loaded control surface which illustrates the availability of forward and reverse thrust compared to watercrafts without this embodiment.
Figure 2B:
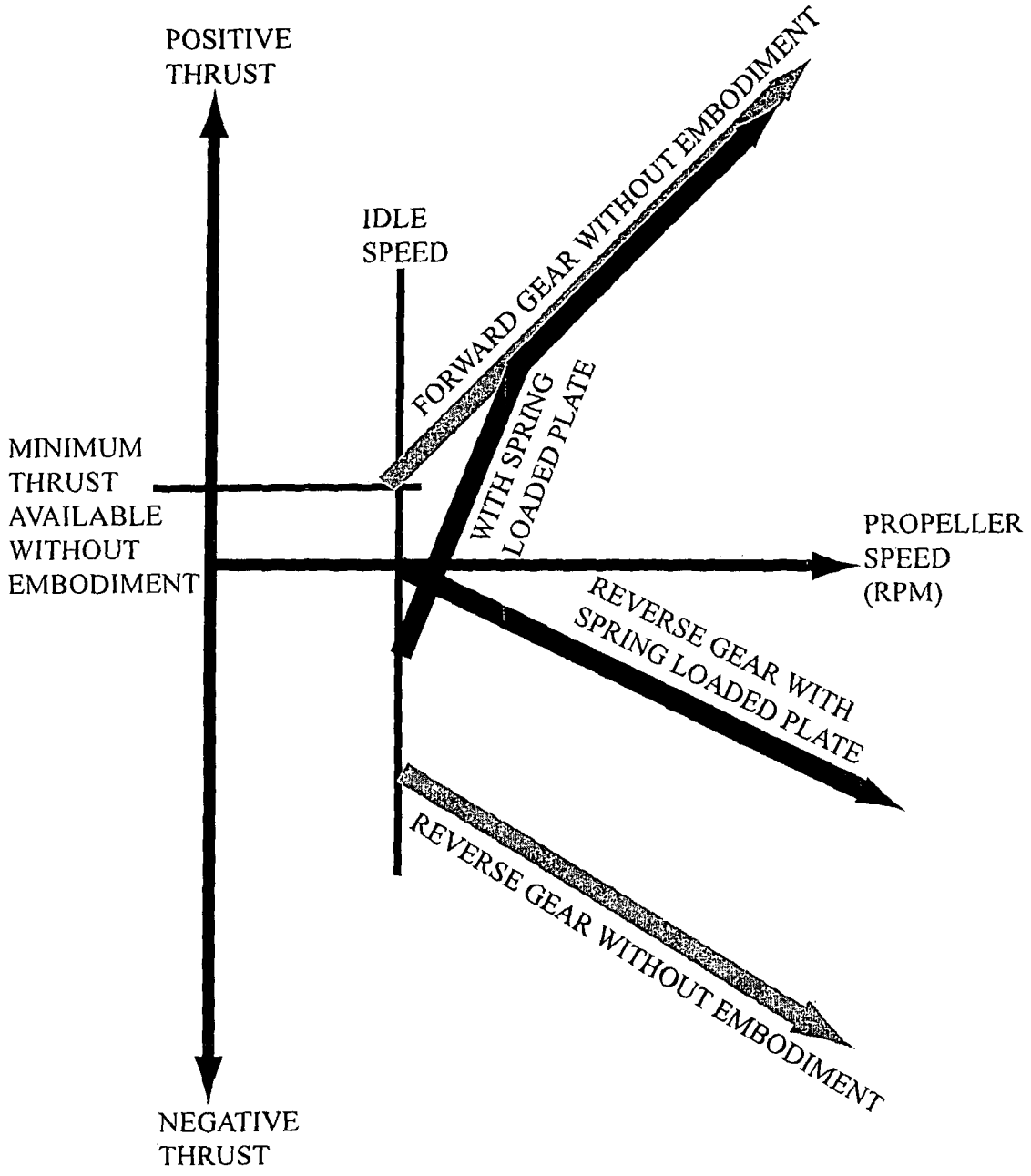
Figure 2C:
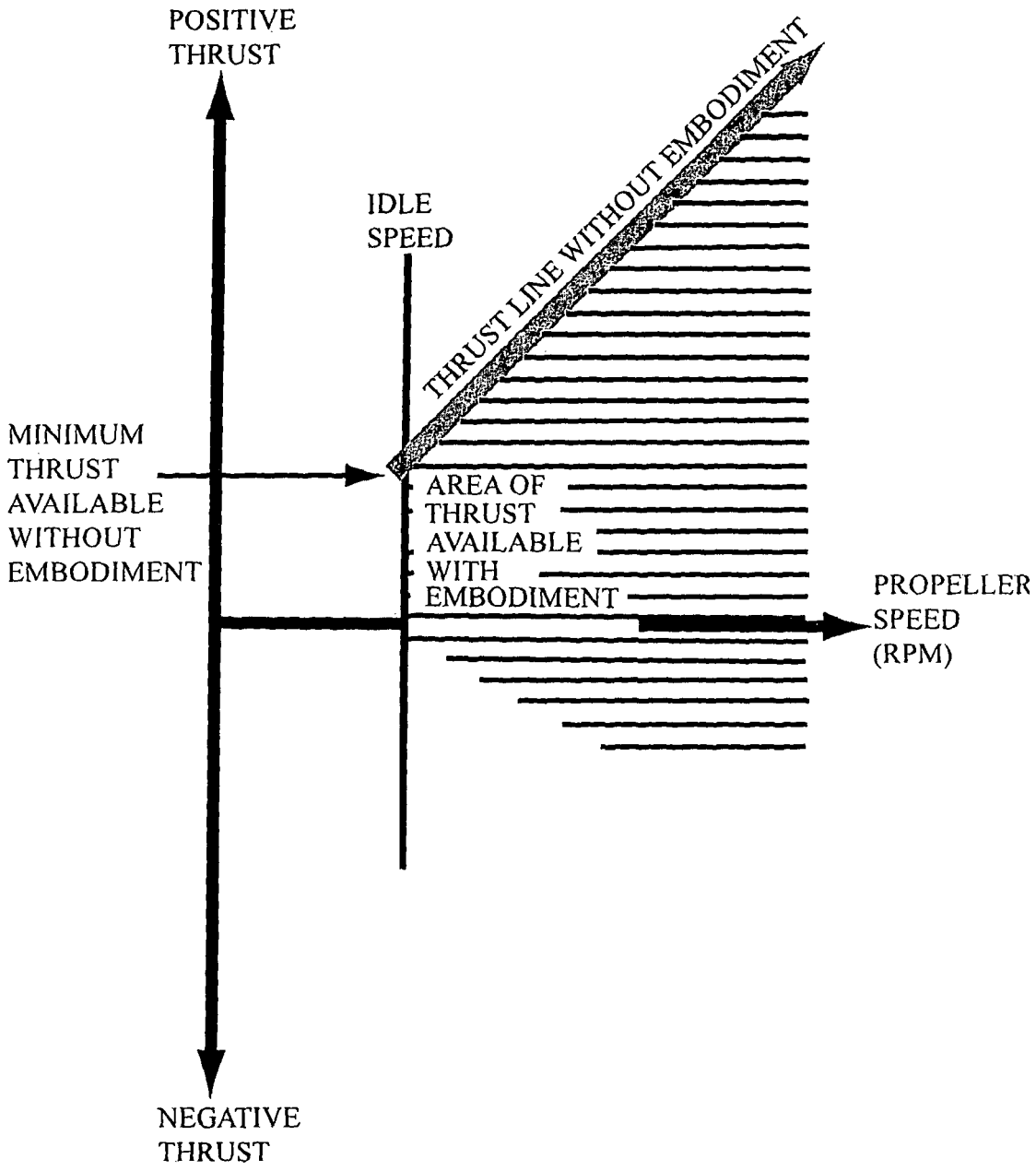
FIG. 2C depicts graphs for an embodiment comprising a non-spring loaded control surface, which can be incrementally activated to achieve any thrust depicted in the shaded area of the graph.

Motor 135 is an outboard motor in the present embodiment that couples with propeller 155 via a transmission. In the present embodiment, control surface 150 compliments the use of gears by advantageously providing finer control over the net thrust offered by propeller 155 via motor 135 at idle speed and offers reverse propulsion without shifting the transmission into a reverse gear. FIGS. 2A-C depict graphs to illustrate differences between a boat with and without this embodiment of the invention.

Control Surface Arrangements

Figure 10A:
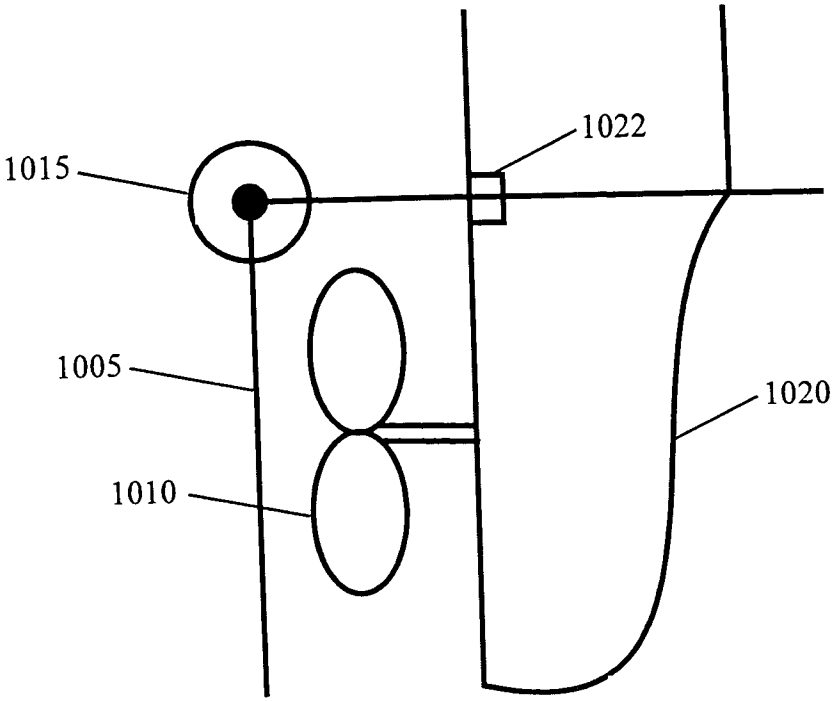
FIGS. 10A-D depict a starboard view of an embodiment of a retrofit kit comprising a control surface to redirect a forward thrust generated by a propeller to provide a reverse thrust.
Figure 10B:
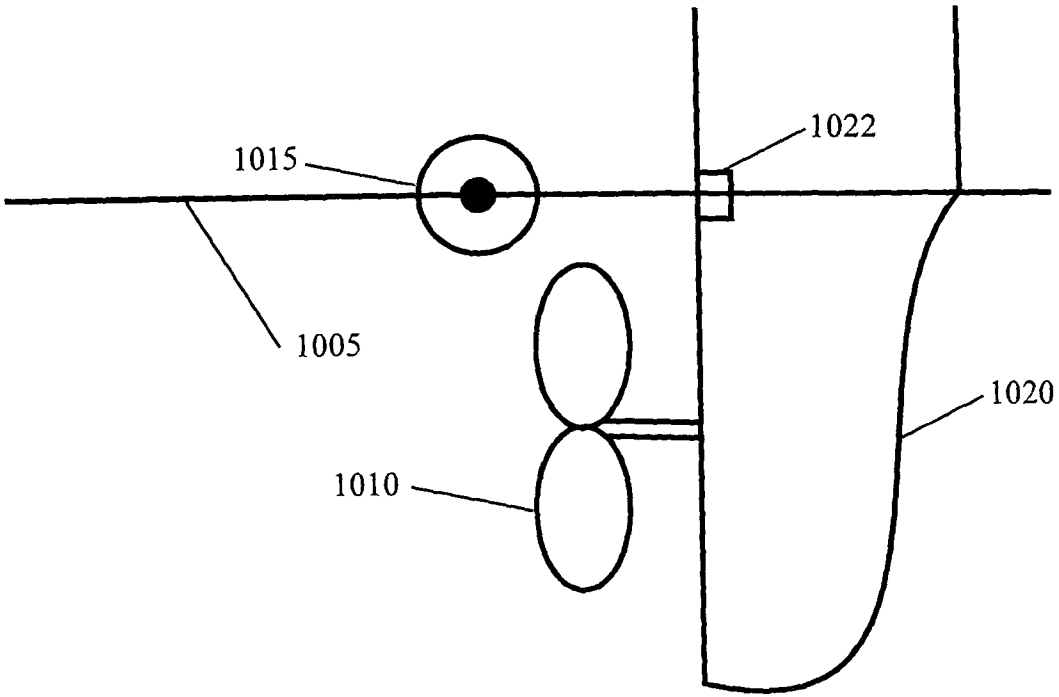

FIGS. 2A-B depict graphs for an embodiment of the invention shown in FIGS. 10A and 10B comprising a spring-loaded plate. In FIG. 2A, the spring is adapted to apply a force on control surface 1005 of FIG. 10A, B to maintain control surface 1005 within the prop wash of propeller 1010 against a forward, or positive, thrust on control surface 1005. As the forward thrust increases, relative to the spring force, the plate raises from the engaged/vertical position of FIG. 10A to the horizontal disengaged position of FIG. 10B, decreasing the magnitude of reverse thrust created by control surface 1005. The effect of spring loading control surface 1005 is that the forward thrust transitions substantially from zero to the full thrust generated by propeller 1005 based upon the loading characteristic of the spring, which advantageously provides thrust down to zero at idle speed as shown in FIG. 2A or optionally reverse thrust per FIG. 2B.

Also note that for embodiments in which the transmission is shifted into a reverse gear, a hinge or other member may physically limit the movement of control surface 1005 toward propeller 1005 to prevent control surface 1005 from contacting propeller 1010. Control surface 1005 may then provide a substantially consistent interference with the water drawn by propeller 1010. Thus, the reverse, or negative, thrust is reduced by a relatively constant proportion.

Figure 10C:
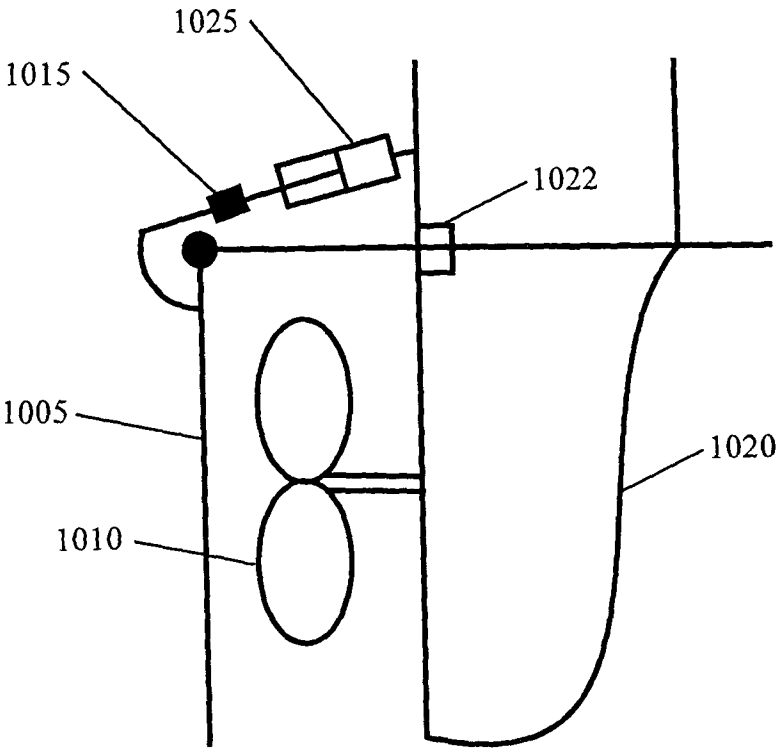

FIG. 2C depicts a graph of an embodiment shown in FIG. 10C that illustrates the availability of forward and reverse thrust when the propeller is providing a forward thrust. And the position of the control surface is not spring loaded but instead may be put in any position regardless of propeller R.P.M. A spring or other overloaded release may also be included in this embodiment.

At lower RPMs, control surface 150 FIG. 1A and 1005 FIG. 10A-C may be positioned to redirect a component of thrust back toward the bow with sufficient thrust to propel a boat in reverse. The position of control surface 1005 determines where the net thrust lies within the shaded area of the depicted graph. The arrow represents the thrust generated by propeller 1010 and, thus, the magnitudes of thrust available when an embodiment is not utilized in conjunction with propeller 1010. At higher RPMs, this embodiment of the invention still provides control over the forward thrust based upon the position of control surface 1005 FIG. 10-C and the granularity of its movement.

Control surface 1005 is adapted to reflect thrust generated by propeller 1010 when the propeller is producing a forward thrust and, in some embodiments, interfere with water flow to propeller 1010 when the propeller is producing a reverse thrust. In another embodiment, control surface 1005 is coupled with boat 150 FIG. 1A in a manner that allows the position of control surface 1005, FIG. 1A to be adjusted to modify the direction in which the thrust is redirected. For example, as shown in FIG. 6B or alternately as shown in 6D and 7A.

Control surface 150, FIG. 1A is positioned via arms 145, 165 and 167. Arm 140 is a fixed length arm coupled with a shaft of motor 135 and is adapted to physically limit the movement of control surface 150 to prevent control surface 150 from hitting propeller 155. Arms 165 and 167 are adjustable arms designed to adjust the angle of control surface 150 with respect to propeller 155 to redirect the thrust generated by control surface 150. More specifically, arms 165 and 167 may angle control surface 150 to redirect components of the thrust upward, backward, port, starboard, or another direction.

Figure 3B:
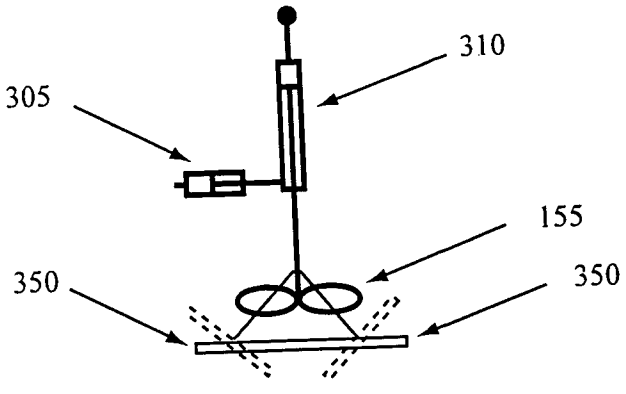
FIGS. 3A-D depict alternate arrangements of adjustable arms to adjust the position of two control surfaces.
Figure 3D:
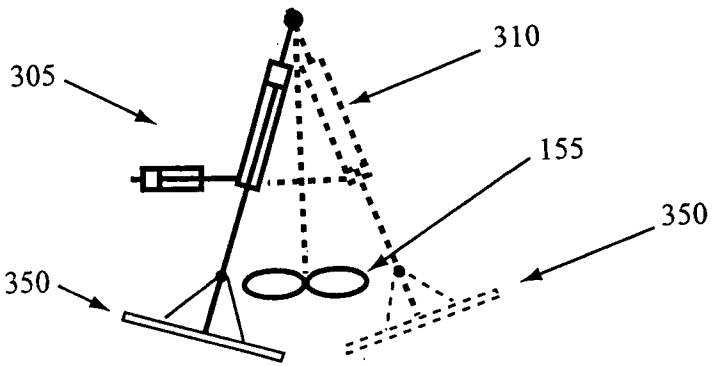
Figure 3A:
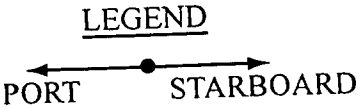
Figure 3A:
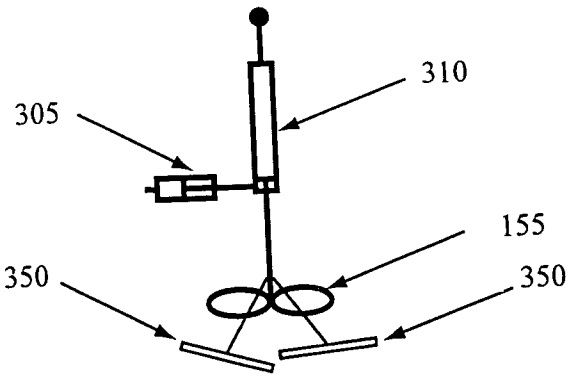
Figure 3C:
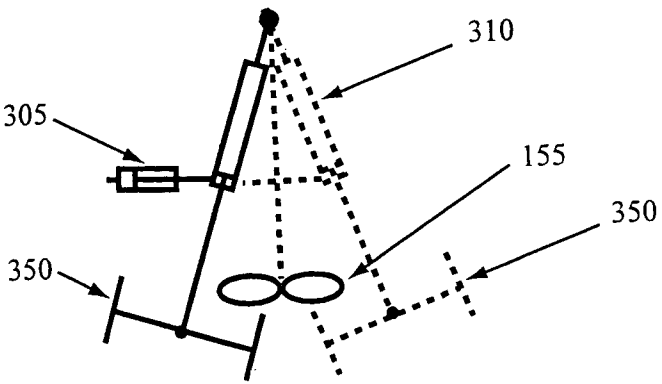

FIGS. 3A-D depict an alternate arrangement of adjustable arms to adjust the position of control surface 150 when control surface 150 comprises two control surfaces 350 rather than one control surface 150. FIGS. 3A-D depict two hydraulically or pneumatically adjustable arms 305 and 310. Alternatively in FIGS. 3A and B, arm 310 may control forward/reverse by incrementally activating control surfaces from parallel to substantially orthogonal to forward motion and independently of the forward reverse function of arm 310. Arm 305 may steer the boat by creating positions similar to shown in FIG. 5D, during reverse, or during forward, by steering the control plates as per normal boat rudders. Alternatively, arm 305 is adapted to pull control surfaces 350 port and push control surfaces 350 starboard as illustrated in FIGS. 3C and 3D and arm 310 is adapted to modify the angles of control surfaces 350 at opposing port and starboard angles or draw the control surfaces into a configuration in which they act as a single control surface like control surface 150 as illustrated in FIGS. 3A and 3B. In other embodiments, control surfaces 350 may angle upward or downward in response to adjustment of the length of arm 310 and, in further embodiments, control surfaces 350 may angle in other directions.

Control surfaces may be of any shape. For instance, control surface 150 may be rectangular, circular, elliptical, or the like. Control surfaces may also be flat or comprise some sort of curvature. For example, control surface 610 of FIG. 6B comprises a main section that is flat and wings or bent edges 605 on the port and starboard sides and, in some embodiments, on the top and bottom edges. The wings may be rounded such as an arc or may be angular at, e.g., 45 degrees to the main surface as per FIG. 6C of the control surface or may be hinged as per 720 FIG. 6D.

Further, control surfaces may be any size from slightly smaller than the diameter of propeller to larger than the diameter of propeller so long as the control surface can produce a sufficiently large reverse thrust. Experiments have shown that reverse thrust sufficient to propel a boat backwards is achievable with a flat control surface that is only slightly larger than the diameter of the propeller and a slightly larger plate with forward pointing edges provides greater reverse thrust.

Control surface 150 may also advantageously block foreign objects from impacting propeller 155 when traveling in reverse. For example, when boat 100 is maneuvering into a position to pull a skier, control surface 150 may prevent the skier from accidentally being injured by propeller 155 and may prevent the ski rope from becoming entangled in propeller 155.

FIGS. 4-5 provide illustrations of control surfaces like control surface 150 and their relationships and interactions with propellers like propeller 155. In particular, FIG. 4A illustrates a two-dimensional, top view of a flat control surface 405 being maintained in a position perpendicular to the forward thrust and directly behind propeller 155. Water 415 is drawn to propeller 150 to produce a forward thrust and propeller 155 propels the water 415 toward control surface 150. Control surface 150, being held in position by arms adapted to attach control surface 150 to boat 100 (not shown), reflects the thrust to create a redirected thrust 410. When reflecting the water back towards propeller 155.

Figure 4B:
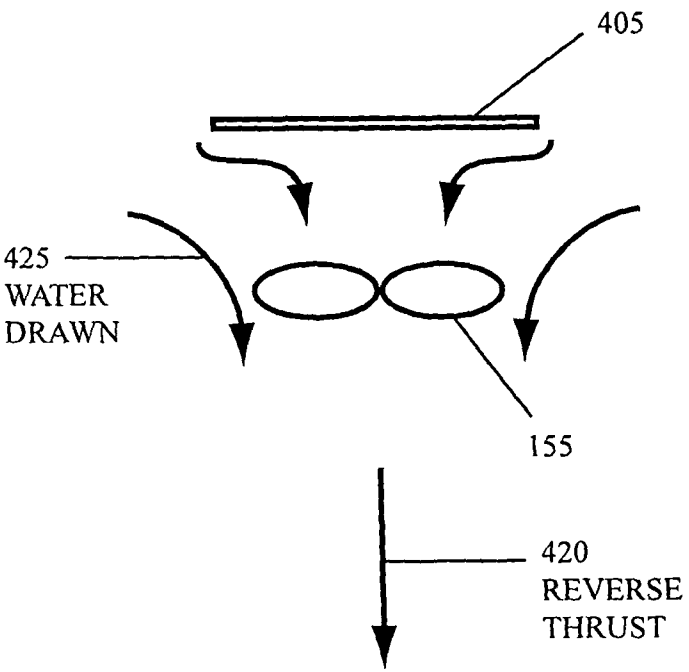
FIGS. 4A-E; illustrate single control surface arrangements and their relationships and interactions with a propeller such as the control surface and propeller depicted in FIG. 1A.
Figure 4A:
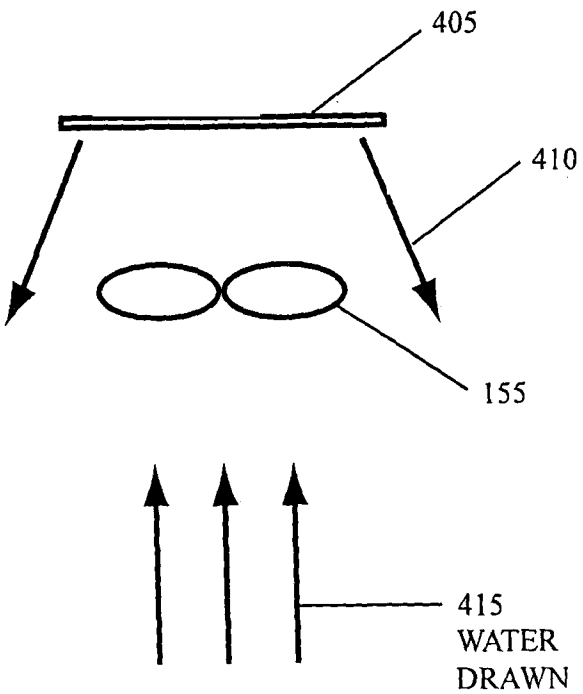

FIG. 4B depicts the same arrangement as FIG. 4A, however, propeller 155 is in reverse rotation, producing a reverse thrust 420 by drawing water 425 around control surface 405. In this situation, control surface 405 impedes the collection of water to propel to generate the reverse thrust 420 so the magnitude of the reverse thrust is reduced, advantageously facilitating slower speeds such as at idle RPM.

Figure 4C:
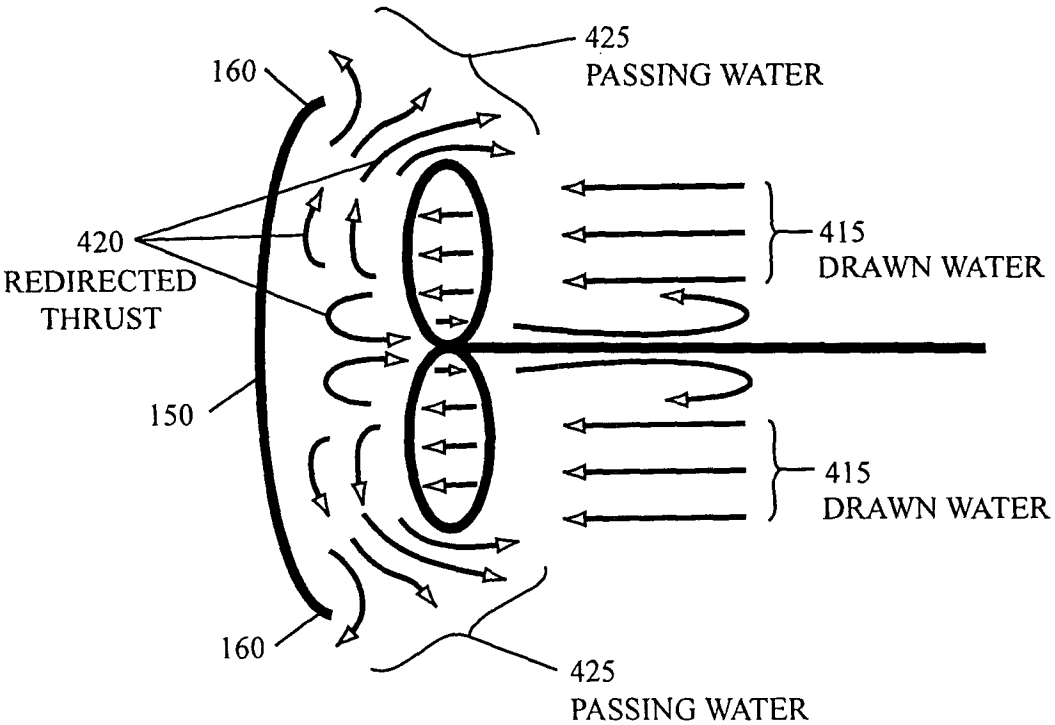

FIG. 4C depicts a similar arrangement as FIGS. 4B-C but control surface 150 comprises bent edges or wings 160. When propeller 155 produces a forward thrust, the wings 160 increase the ability of control surface 150 to redirect the thrust 420 to create a component of reverse thrust. Experimental measurements show that even a flat control surface only slightly larger in diameter than the propeller can produce reverse thrust, because water flow sucked into propeller 155 creates a lower pressure area, which turns the water leaving the edge of control surface 150 in the reverse direction. When control surface 150 is close to propeller 155, the Bernoulli effect causes the force required to hold control surface 150 against the stream of water from the propeller to drop to less than 25% of its maximum value when control surface 150 is farther away. This is advantageous, for example, for a spring-loaded control surface as per FIG. 10A. Further, moving control surface 150 sideways produces rotational thrust because the water leaving one side of the propeller is reversed and water from the other side is not. Also note, however, that placing control surface 150 very close to propeller 155 may significantly restrict the angular rotation of control surface 150.

Figure 4D:
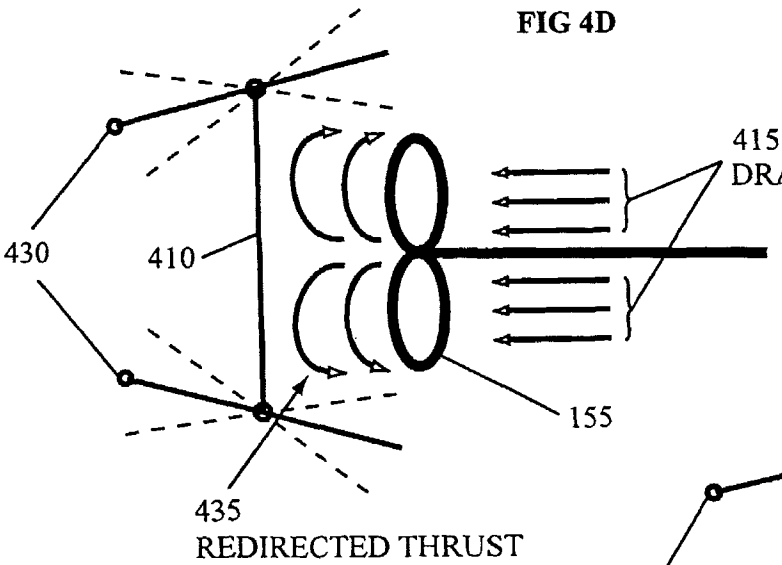
Figure 4E:
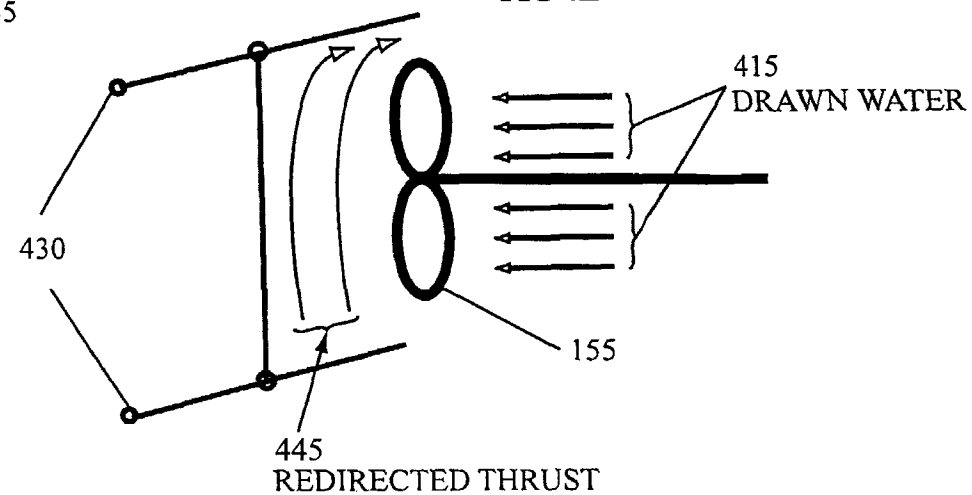

FIGS. 4D-E depict an arrangement with wings like FIG. 4C, however, the wings 430 are at adjustable angles with respect to the flat control surface 440. In some embodiments, wings 430 may be coupled to flat control surface 440 via springs or otherwise coupled with boat 100 via springs. In further embodiments, adjustable arms or cables may be coupled with wings 430 to allow adjustment of the angle of wings 430 with respect to flat control surface 440 manually or by some other means. For example, controller 115 of FIG. 1 may control the angle of each wing of wings 430 independently or as a unit.

As shown in FIG. 4D, wings 430 may be utilized to adjust the magnitude of the reverse thrust component of the redirected thrust 435 by widening or narrowing the area within which the forward thrust is redirected. Widening the capture area may increase the magnitude of the reverse thrust component while narrowing the capture area may decrease the magnitude of the reverse thrust component. Adjusting both wings 430 to port or starboard as depicted in FIG. 4E forces most or all of the thrust to be redirected to port or starboard, respectively, generating a force 445 that causes boat 100 to rotate. In further embodiments, wings 430 may be placed on any edge of flat control surface 440, allowing forward thrust to be redirected up, down, or any other direction. Note that control surfaces may generate net thrust in any desired direction motion forward, reverse or for sideways or may generate two components of thrust which, offset and roughly opposing may rotate the boat in place. Thus at slow speed, every possible combination of rotational and directional motion may be achieved in some embodiments.

FIGS. 5A-E depict two control surface embodiments of the present invention. In other embodiments, any number of control surfaces may be utilized to redirect thrust from a propeller 520.

Figure 5A:
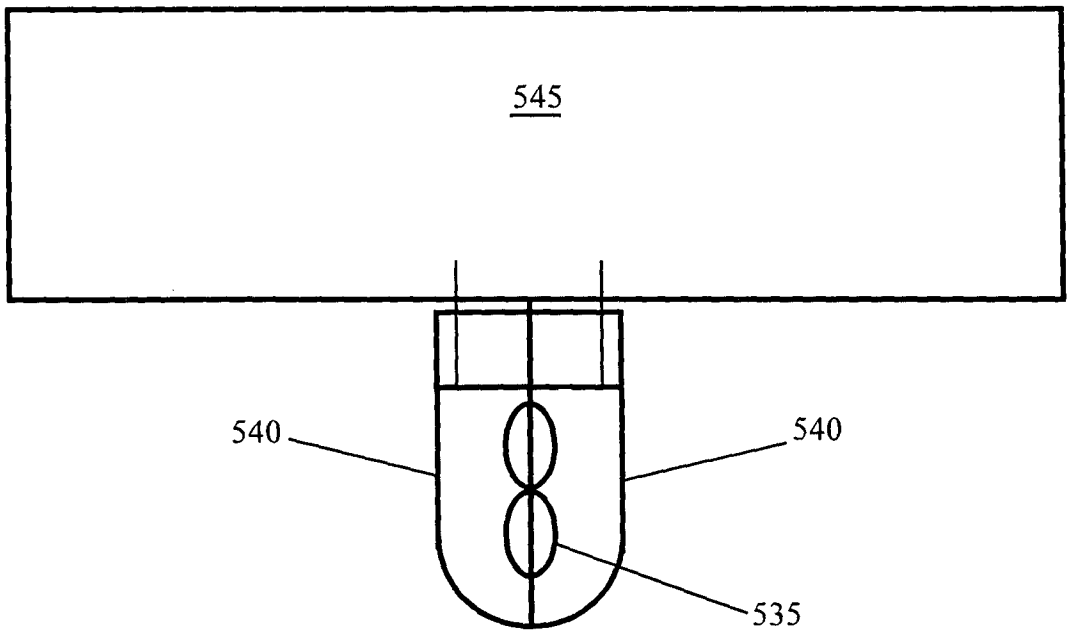
FIGS. 5A-E illustrate two-control surface arrangements and their relationships and interactions with propellers and FIG. 5D may be controlled by the pneumatics of FIG. 3B.
Figure 5B:
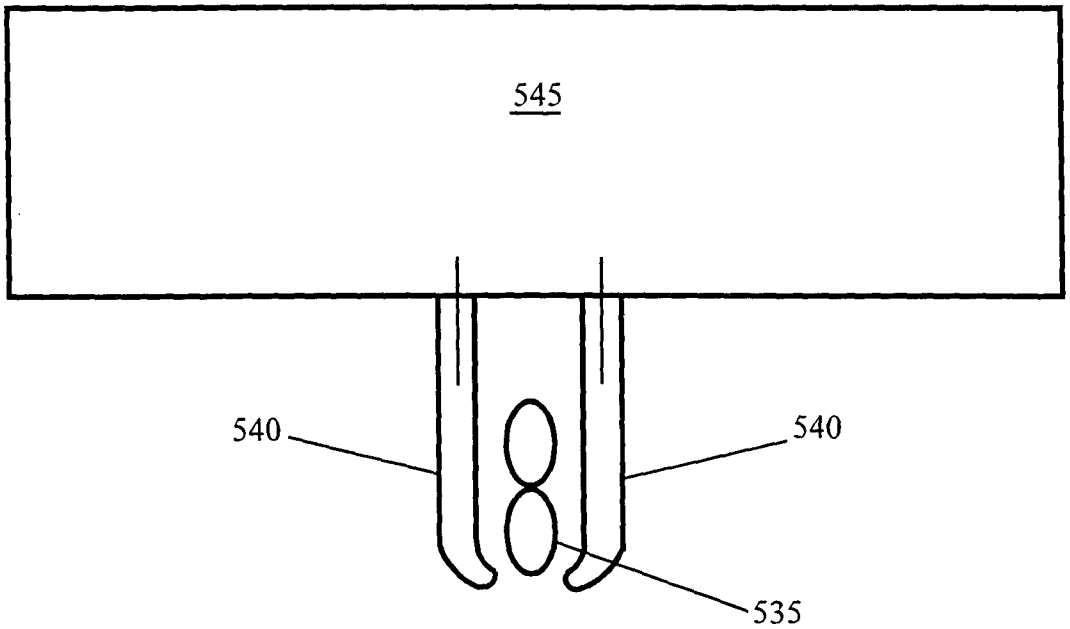

FIGS. 5A-B show an alternate arrangement of control surfaces 540. FIGS. 5A-B show the rear of a boat looking at the transom 545 toward the bow. In FIG. 5C, two rudder-like control surfaces 540 substantially enclose propeller 535. More specifically, control surfaces 540 comprise curvatures that are parallel with the direction of water flow at cruising speed but substantially block water propelled by the bow and redirect the water back toward the propeller 535 to create a net reverse thrust. FIG. 5B illustrates control surface 540 from the same perspective after control surfaces 540 have been rotated to allow of the water propelled by propeller 535 to escape to add a component of forward thrust. Depending upon how wide the opening between the two control surfaces in the position shown in 5B the control surfaces are parallel to water flow and may act as traditional rudders to steer the boat during forward motion. The dual rudder configuration has the added advantage of reducing drag because the rudders are not directly in the prop wash except when turning, which is when it is desirable for added steerability, and, this dual rudder embodiment can turn a boat in a smaller radius than a single rudder.) Note that the hydraulics, or otherwise powered control arms, 310 and 305 of FIG. 3B can independently control steering (305) and forward/reverse (310) for the control plate configurations shown in FIGS. 5A-E, 8B, and 3A-D.

Figure 5E:
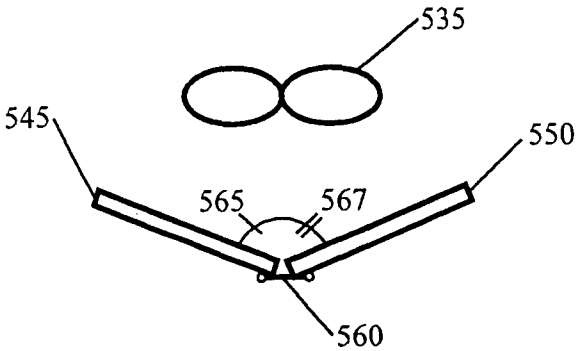
Figure 5C:
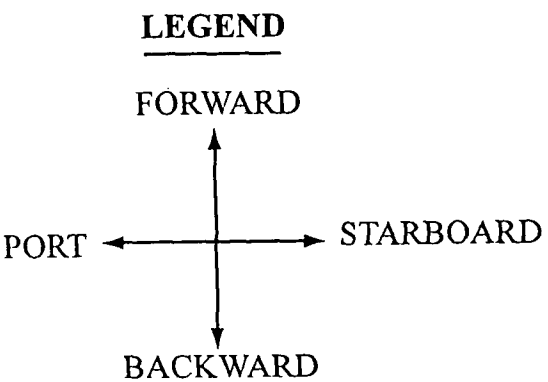
Figure 5C:
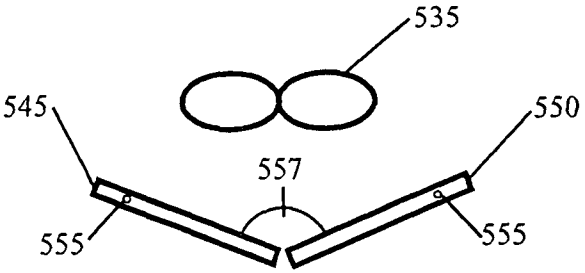
Figure 5D:
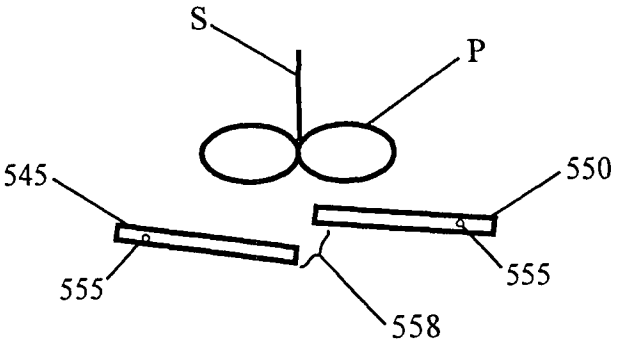

FIGS. 5C-D illustrate two flat control surfaces 545 and 550 and positions when control surfaces 545 and 550 are hinged on outer edges 555. As shown in FIG. 5C, control surfaces 545 and 550 may be positioned such that when the inner edges of control surfaces 545 and 550 are brought together to reflect thrust from propeller 535 forward, control surfaces 545 and 550 form an angle 557. Angle 557 enhances the magnitude of the reverse thrust component of redirected thrust relative a single flat surface.

FIG. 5D illustrates an arrangement of the two control surfaces 545 and 550 in which control surfaces 545 and 550 are repositioned to leave a small gap 558 in the middle of the two control surfaces 545 and 550. The small gap allows water propelled by propeller 535 to escape starboard to create a rotational force that turns boat 100 starboard.

FIG. 5E illustrates control surfaces 545 and 550 when hinged at the inner edges 560 rather than the outer edges like FIGS. 5C-D. When angles 565 and 567 are at maximum, 550 and 545 are together and in the common position of a typical rudder; which finction they then provide during forward motion. Additionally the rotation shafts for 545 and 560 may be concentric, which allows for retrofitting an existing inboard using an existing single rudder shaft hole. When control surfaces 545 and 550 are positioned such that angles 565 and 567 are equivalent, control surfaces 545 and 550 are adapted to provide a component of reverse thrust substantially without a rotational or sideways force based upon the thrust generated by the propeller 535. When angle 567 is smaller than angle 565, a force is produced to turn boat 100 to port and vice versa. In further embodiments, controller 115 (shown in FIG. 1A) may compensate for extraneous forces that create rotational or sideways forces by dynamically adjusting the difference between angles 565 and 567.

Referring again to FIG. 1A, propeller 155 may be a single propeller, dual propeller, composite propeller, steel propeller, or the like. Propeller 155 comprises a shaft to couple with motor 135 and blades adapted to capture and propel water in a direction to provide thrust for boat 100. In many embodiments, propeller 150 may be rotated in one direction such as clockwise to create a forward thrust and an opposite direction such as counter-clockwise to produce a reverse thrust.

Watercraft and Inboard-Outboards (IOs)

FIGS. 6C, 6D and 7A and 7B depict an alternative embodiment for an outboard or IO watercraft, 600, to redirect a forward thrust generated by a propeller 610 more than is achieved by rotation of the whole drive unit. This is achieved when arm 710 in FIGS. 6D, 7A and 7B strikes plate 605 or wings 720 as the drive unit is turned to maximum steering position. Boat 600 includes one or more control surfaces 605. Adjustments to the spatial relationship between the control surfaces 605 and propeller 610 may redirect the thrust generated by propeller 610. Some embodiments of FIGS. 6-7 may comprise other features such as a controller, sensors, and the like as discussed above.

Figure 6A:
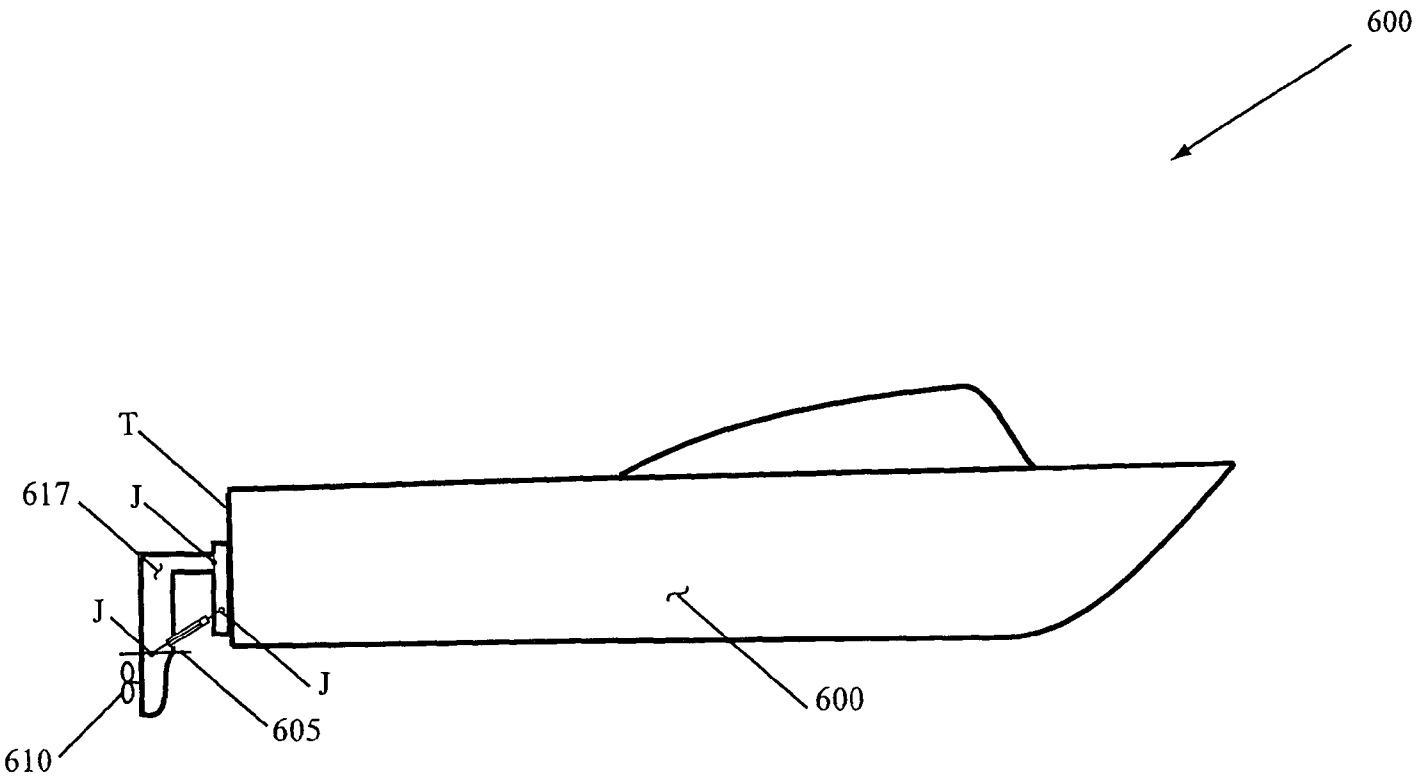
FIGS. 6-7 depict an inboard-outboard (IO) embodiment to redirect a forward thrust generated by a propeller to provide a reverse thrust.
Figure 6B:
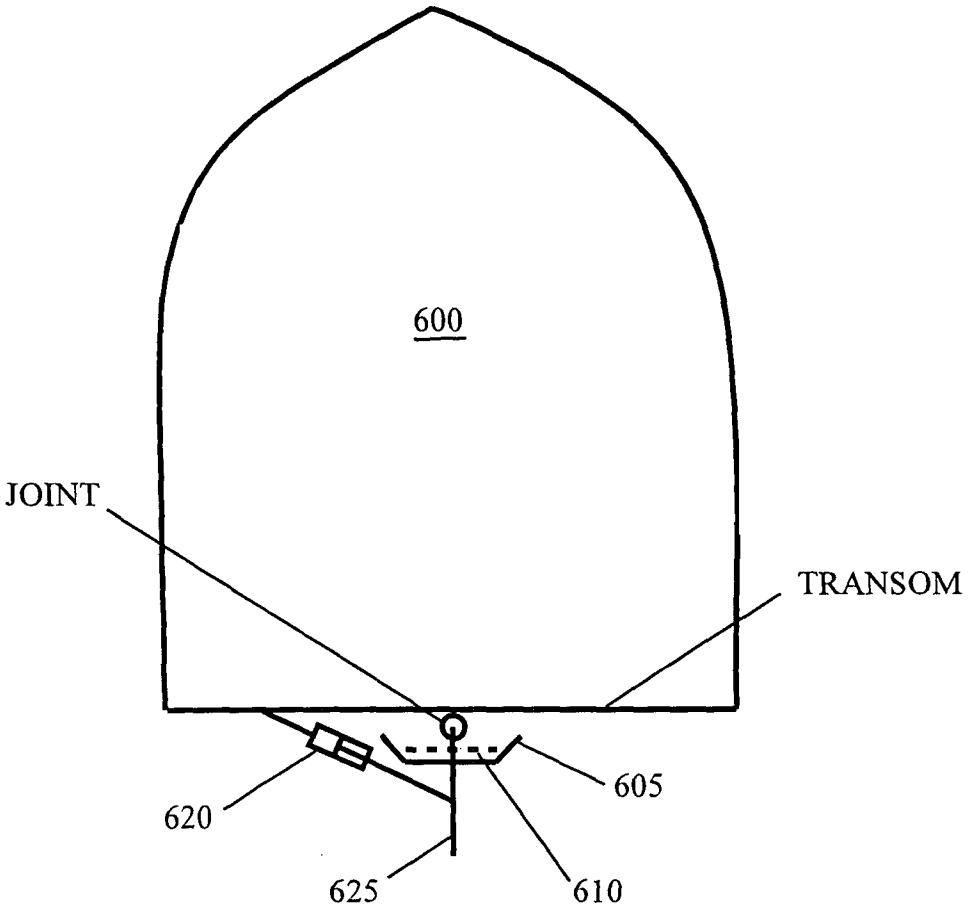

FIG. 6A depicts a standard 10 drive watercraft 600 with outboard drive unit 617, propeller 610, hydraulic cylinders 605 to adjust the trim (forward/aft angle) of the boat, transom "T" and hinge points "J".

FIG. 6B depicts a top view of FIG. 6A with adjustable arm 620 fully extended. Adjustable arm 620 couples with control surface 605 via a rigid arm 625 to position control surface 605 directly behind propeller 610. Rigid arm 625 is adapted to limit movement of control surface 605 to prevent control surface 605 from hitting propeller 610.

Figure 6C:
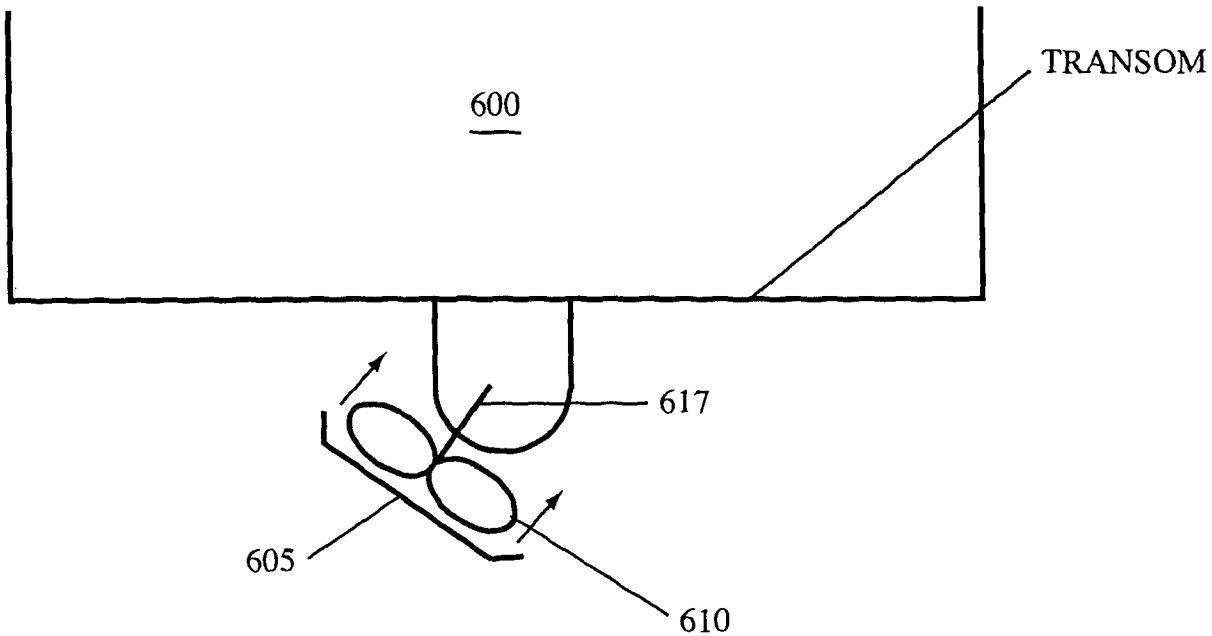

FIG. 6C depicts a top view of FIG. 10A, which depicts optional side wings on control plate 605.

Figure 6D:
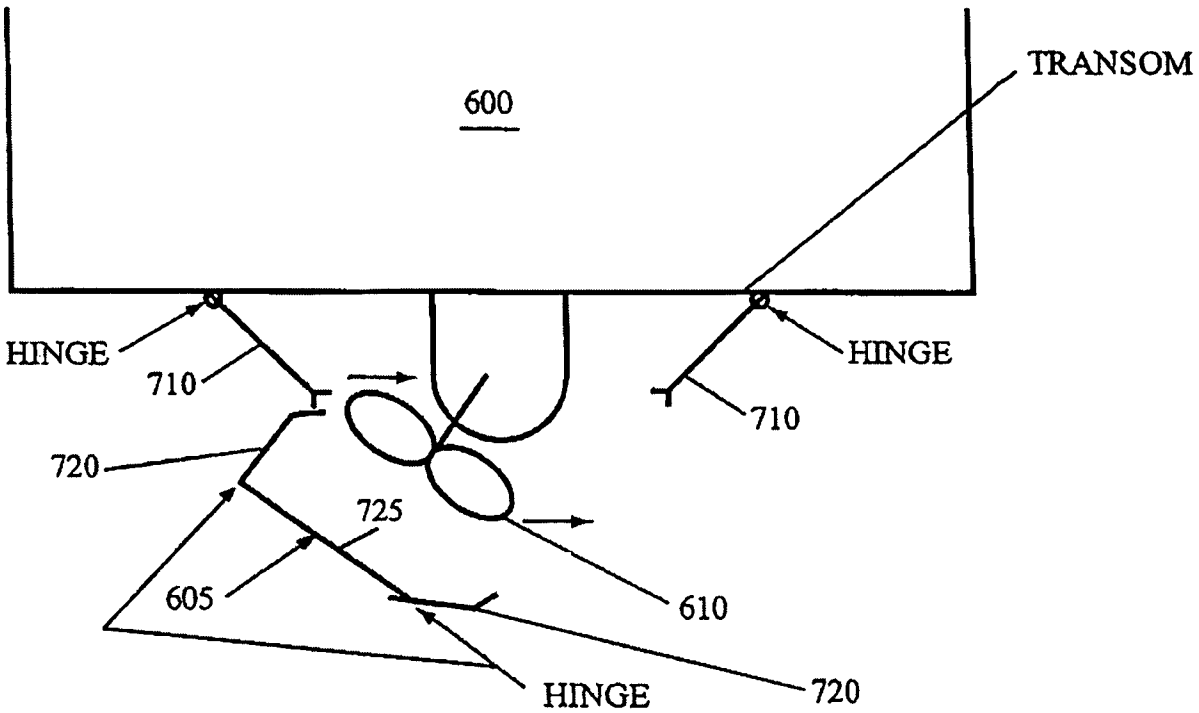
Figure 7A:
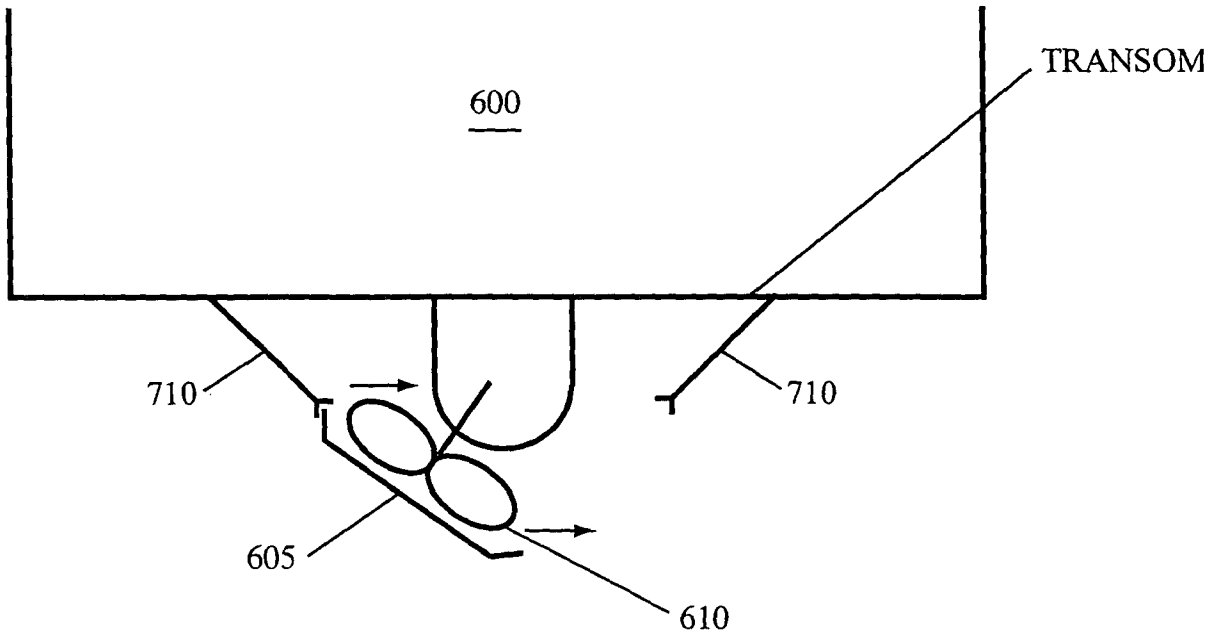
Figure 7B:
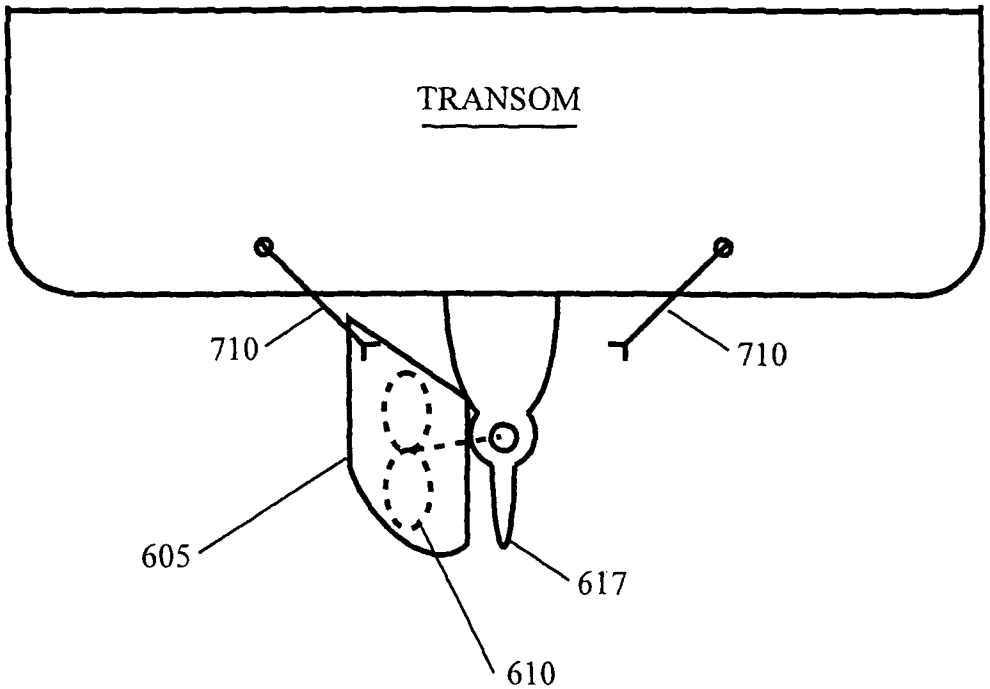

In FIG. 6D, wings 720 are adapted to pivot with respect to the flat portion 725 of control surface 605 in response to contact with one of the rigid members 710, which increases the change in the angle of the corresponding wing 720 with respect to the flat portion 725 of control surface 605 per change in the angle of control surface 605.

Watercraft and Inboards

Figure 8A:
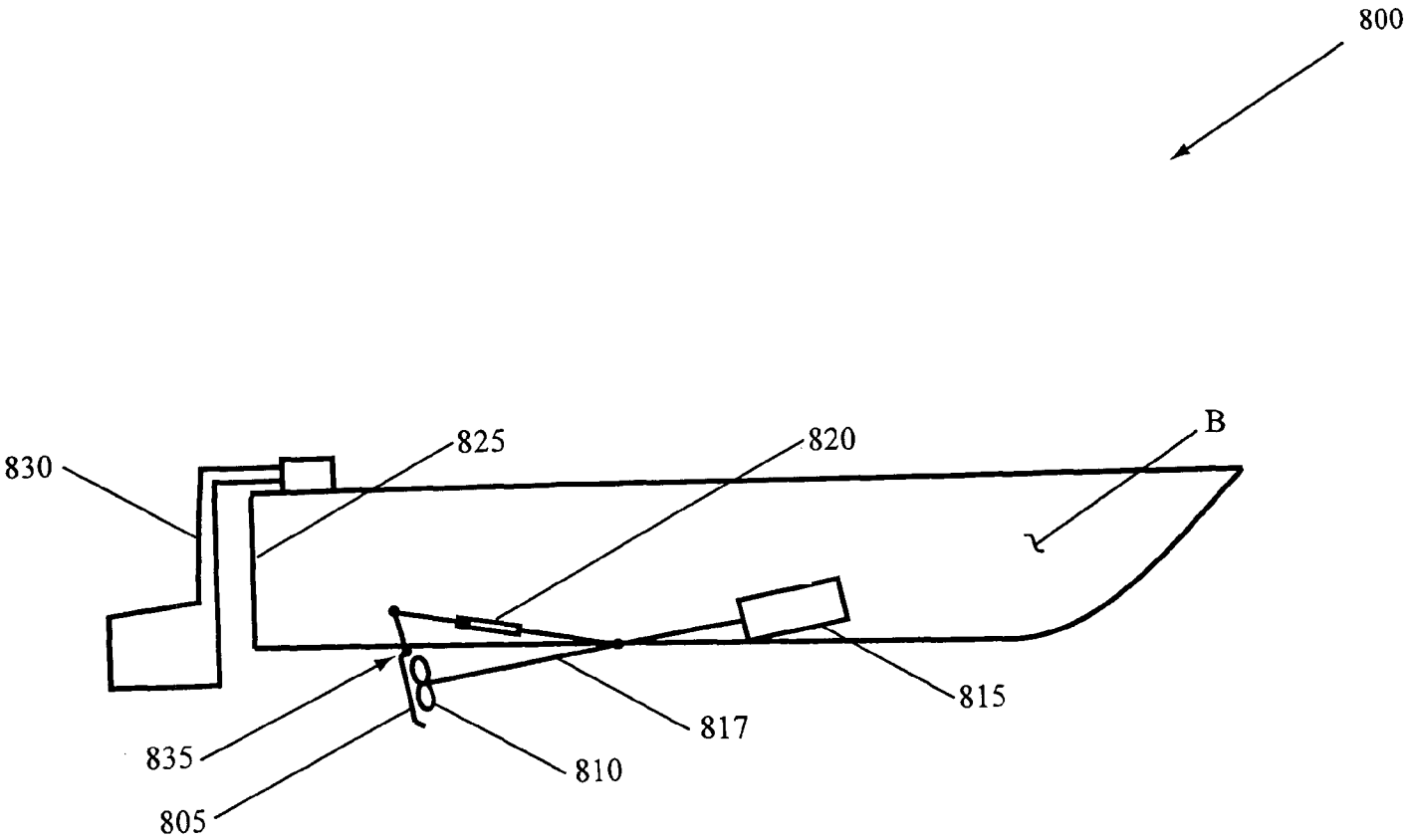
FIGS. 8-9 depict inboard embodiments to redirect a forward thrust generated by a propeller to provide a reverse thrust.
Figure 8B:
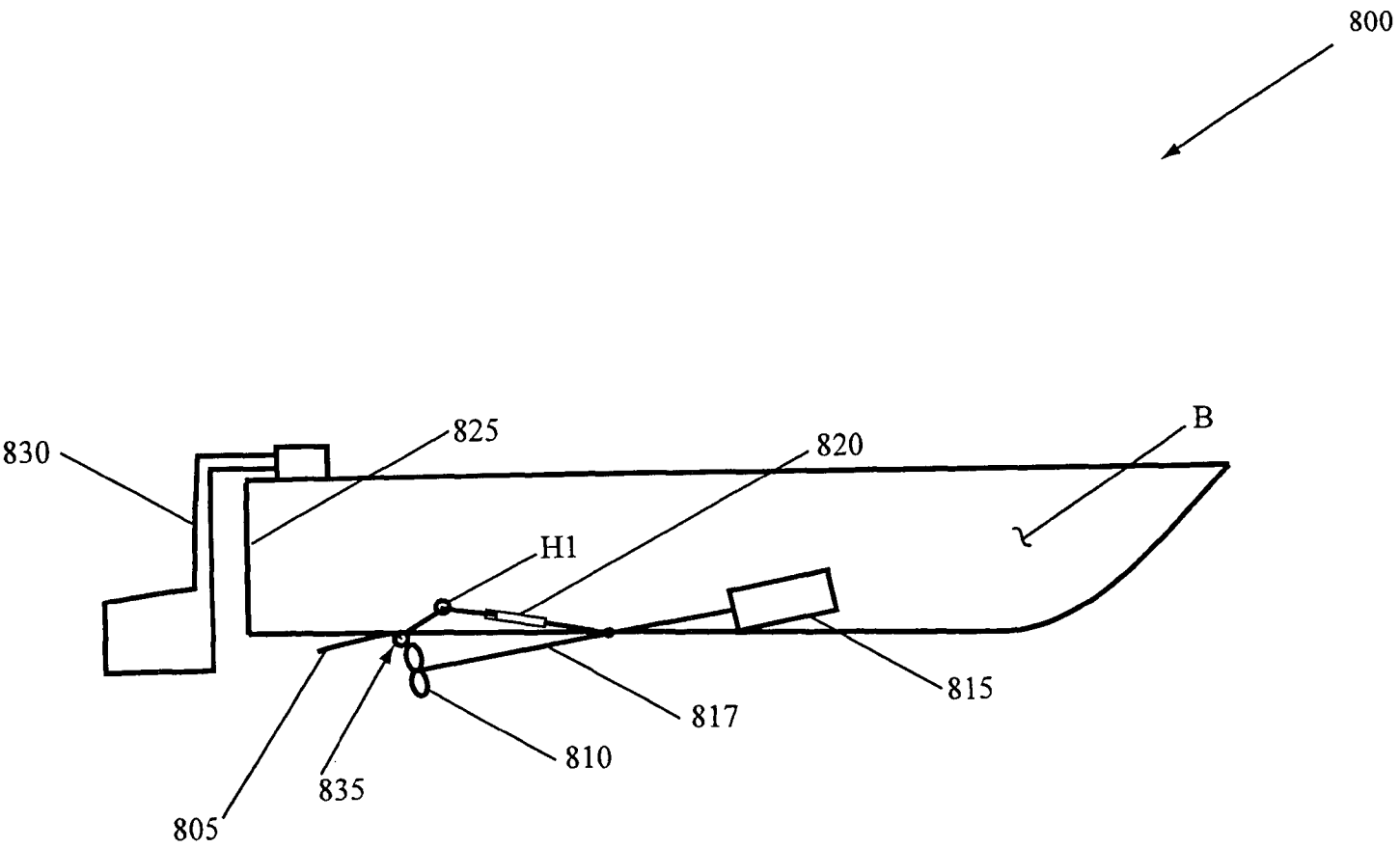

Turning to FIGS. 8A-B, there is shown a starboard side view of inboard 800 having a control surface 805, to redirect a forward thrust generated by a propeller of inboard 800 to provide a non-forward thrust. Inboard 800 comprises a motor 815 coupled with propeller 810 via a shaft 817, an adjustable arm 820 coupled with a control surface 805 via is a rotary feed through which allows for an arm of adjustable arm 820 to rotate and/or change angle to modify the position of control surface 805, and a rudder 830 coupled with the transom 825. Optionally motor 815 is coupled through a gearbox to rotate the propeller either direction to generate a forward thrust or reverse thrust. FIG. 4C shows how reverse is achieved with the configuration in FIG. 8A without using reverse gears.

FIG. 8 depicts an alternative embodiment of a watercraft, inboard 800, to redirect a forward thrust generated by a propeller 810 to provide a non-forward thrust. Inboard 800 comprises one or more control surfaces 805 adapted to redirect the thrust generated by propeller 810. Adaptations facilitate adjustment of the spatial relationship of the control surfaces 805 with respect to propeller 810. FIG. 8A shows the control surface in the reverse thrust position and FIG. 8B in the forward thrust position. The FIG. 8A reverse position steering is achieved by rotation of the plate shaft or by control surface movement side to side through universal joint 835 that is achieved by movement side-to-side of the top end of the shaft at "H1" in FIG. 8B. This same movement side-to-side of "H1" creates steering during forward motion if control surface 805 has side wings or is curved as per FIG. 4C. Thus the same hydraulic (or otherwise powered) side-to-side movement of 805 creates steering while in both forward or reverse configuration. It is clearly an advantage when connecting to a single steering wheel to be controlling the same lever regardless of forward/neutral/reverse thrust setting. Alternately rudder 830 FIG. 8A, B may be used for forward steering. Some embodiments of inboard 800 may comprise other features such as a controller, sensors, and the like as discussed above.

When propeller 810 is producing a forward thrust, control surface 805 is adapted to reflect the forward thrust to produce a component of reverse thrust. In some embodiments, the component of reverse thrust is sufficient to propel boat backwards. In further embodiments, control surface 805 may be angled in other directions such as to port or starboard to enhance steering capabilities. For example, in one embodiment, inboard 800 is adapted to angle control surface 805 to port or starboard in response to turning rudder 830 to port or starboard.

FIG. 8B depicts boat 800 when control surface 805 is raised up substantially out of the way of the prop wash to minimize the impact of control surface 805 on propulsion via propeller 810. Control surface 805 may advantageously be drawn up when entering shallow waters to avoid an impact between control surface 805 and rocks or the lakebed or seabed.

Figure 9A:
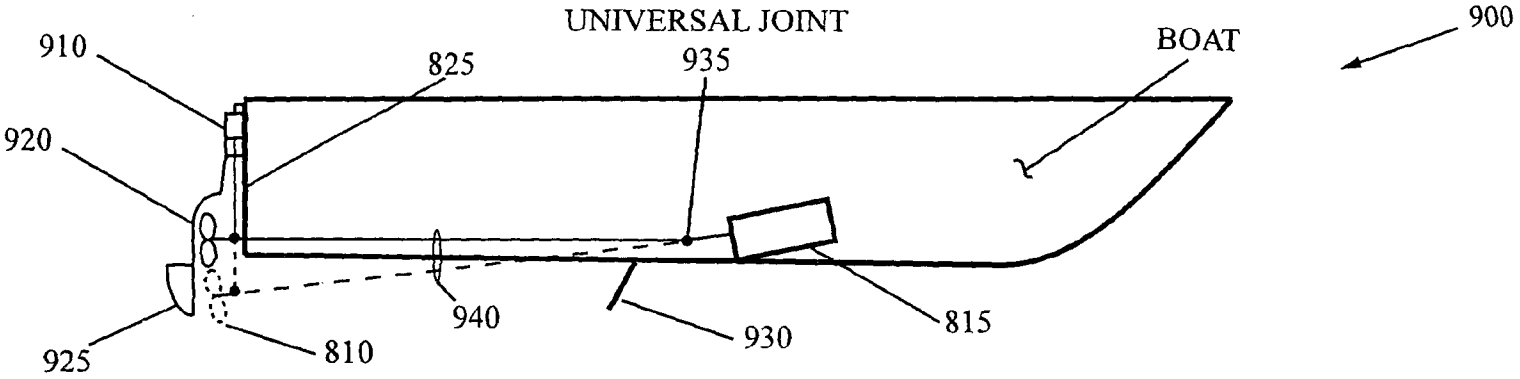
Figure 9B:
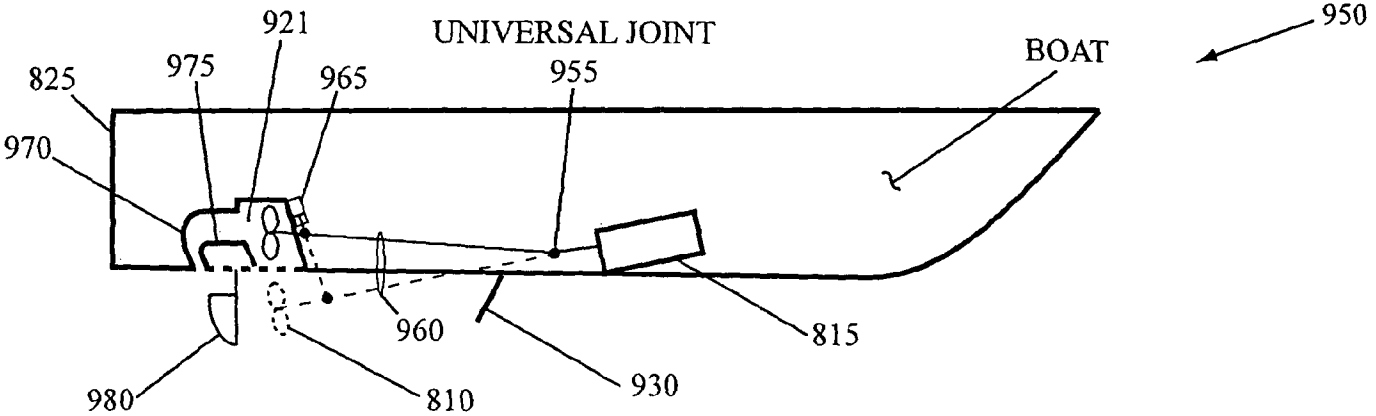

FIGS. 9A and 9B depict inboard boats 900 and 950, respectively. In FIG. 9A, a control surface 920 is incorporated into the design of a rudder 925 and a propeller shaft 940 is adapted to rise behind the boat 900 via a universal joint 935. The boat operator may raise propeller 810 behind control surface 920 to redirect the prop wash to produce a net, non-forward thrust. Steering may be achieved in any propeller position by rotation of the shaft, which simultaneously controls both the rudder 925 and control plate 920. In the event of shallow water, the boat operator may raise propeller 810 and rudder 925 to avoid damaging propeller 810 and rudder 925. Furthermore, raising propeller 810 to substantially a perpendicular position with respect to forward motion of boat 900 has the advantage of increasing propulsion efficiency at higher speeds.

In many embodiments, raising the propeller when under forward power requires 10-100 times less force compared to an IO drive or outboard when under full forward thrust. This means that if a person, the lake bottom or other object is hit, raising the propeller to prevent propeller damage and to save the life of the swimmer can be more quickly and safely accomplished.

Boats 900 and 950 also comprise a skag 930 to detect an obstacle prior to the obstacle hitting the propeller. Skag 930, upon contacting an obstacle, may trigger a driver such as a hydraulic, electrical, or pneumatic system to automatically retract arm 910 to raise propeller 810 behind transom 825 of boat 900. Additionally, for safety, rudder 925 may be adapted to hinge up if it hits something. In FIG. 9A, a control surface 920 is incorporated into the design of a rudder 925 and a propeller shaft 940 is adapted to rise behind the boat 900. For instance, the boat operator may raise propeller 810 behind control surface 920 to redirect the prop wash to produce a net, non-forward thrust. The net, non-forward thrust may slow forward motion of boat 900, propel boat 900 in reverse, turn boat 900 to starboard, and/or turn boat 900 to port. In the event of shallow water, the boat operator may raise propeller 810 and rudder 925 to avoid damaging propeller 810 and rudder 925. Furthermore, raising propeller 810 to where only about 10% of the propeller is below the boat bottom maintains some forward thrust and has substantially more maneuverability than an outboard or 10 with a partially raised drive unit because the propeller drive shaft remains substantially horizontal.

In FIG. 9B, a control surface 920 is incorporated into the design of the hull of boat 950 as control surface 970 in a cavity 921 formed by hull segment 975. The boat operator may lower shaft 960 to lower propeller 810 to a position that directs the prop wash across rudder 980, as depicted in dashed lines. Alternatively, the boat operator may raise shaft 960 to raise propeller 810 into a pocket in the underside of the hull that directs the prop wash through cavity 921 to control surface 970 and backwards over a rudder controller 975. The control surface 970 redirects the prop wash at the rudder 980 toward the front of boat 950. Redirecting the prop wash across the rudder toward the front of boat 950 provides reverse propulsion with immediate maneuverability because the rudder is in the prop wash. Other embodiments may provide sideways propulsion by additional, sideways outlets to cavity 921 which are either independently controlled or which are controlled by a horizontal plate on top of the rudder, or by an extension of rudder 980 which fits over or into the exit of cavity 921 to redirect thrust to port or starboard depending on the position of 980.

Boat 950 has a shaft 960 with a universal joint 955 to facilitate raising and lowering propeller 810. Adjustable member 965 may couple with a driver system such as a hydraulic system to raise and lower shaft 960. In further embodiments, adjustable member 965 may be manually controlled by a boat operator.

Retrofit Kits

Turning to FIGS. 10A-D, there is shown a starboard side view of an embodiment of a retrofit kit comprising a control surface 1005, to redirect a forward thrust generated by a propeller 1010 to provide a reverse thrust. The retrofit kit may also comprise a coupling to rigidly couple control surface 1005 to a rudder 1020 of a watercraft. Attaching control surface 1005 directly to the drive unit avoids propeller striking control plate when steering.

While FIGS. 10A-D illustrate the attachment of control surface 1005 with rudder 1020 above propeller 1010, other embodiments may attach control surface 1005 to rudder 1020 at another location such as at a location below propeller 1010. In other embodiments, control surface 1005 may be attached to the transom or other portion of the hull of the watercraft.

Control surface 1005 comprises a spring-loaded hinge that provides resistance against forward thrust generated by propeller 1010. Spring-loaded hinge 1015 may also limit movement of control surface 1005 to prevent control surface 1005 from impacting propeller 1010. In FIG. 10A, control surface 1005 is shown is the full reverse thrust position and in FIG. 10B, control surface 1005 is shown in the minimal reverse thrust position. Control surface 1005 gradually transitions through each angle in between these positions as the forward thrust from propeller 1010 counteracts the force applied to control surface 1005 by spring-loaded hinge 1015.

Simpler embodiments may comprise control surface 1005, spring-loaded hinge 1015, and coupling 1022 adapted to attach control surface 1005 to rudder 1020. In some embodiments, coupling 1022 may be universal, being adaptable for outboards, IOs, inboards, or other watercraft. In other embodiments, coupling 1022 may be more specifically designed for one or more types of watercraft. In still further embodiments, retrofit kits may be adapted for specific manufacturers and/or models.

Figure 10D:
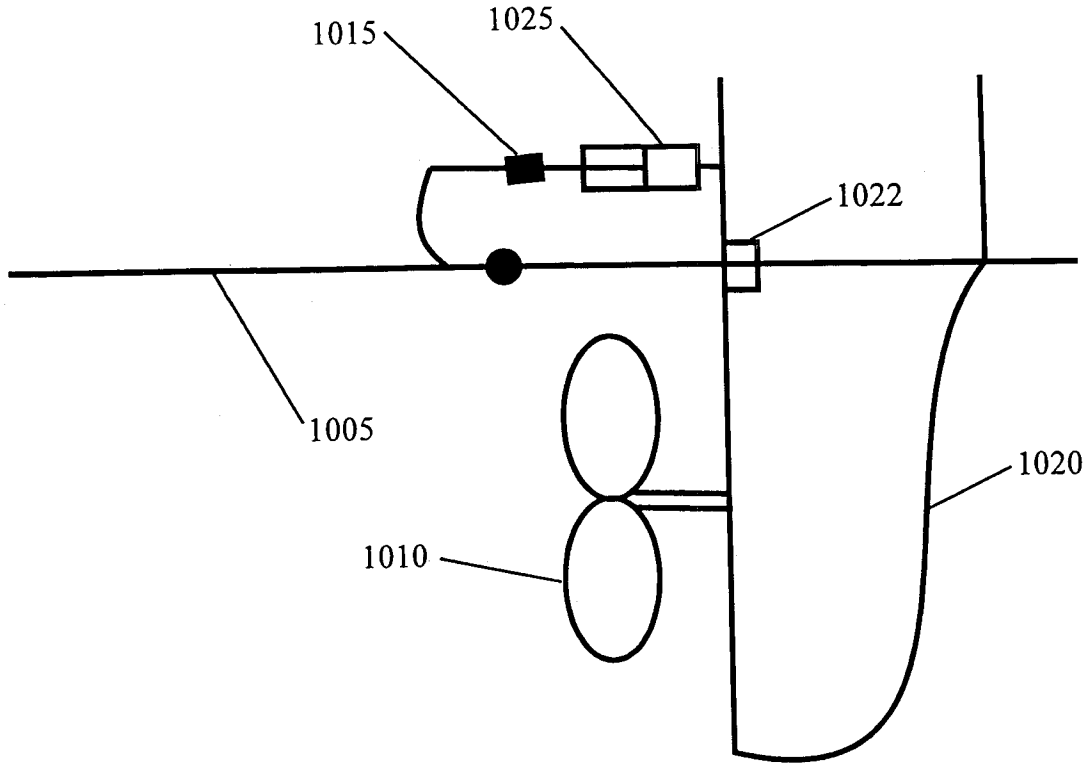

Further embodiments comprise an adjustable arm adapted to couple with an existing or new driver such as a hydraulic pump, an electrical motor, a pneumatic compressor, or the like. FIGS. 10C-D illustrate the embodiment of FIGS. 10A-B with an adjustable arm 1025 adapted to provide force in addition to the force applied via the spring to adjust the position of control surface 1005. In FIG. 10C, control surface 1015 is shown is the full reverse thrust position and in FIG. 10D, control surface 1015 is shown in the minimal reverse thrust position. Such arrangements provide a means for intervention in the position of control surface 1005 either manually or via the driver. Some retrofit kits comprise the new driver. A spring, hydraulic relief valve, break away member, overload strut, or other overload release mechanism may be included to prevent damage when stresses on any part of the control surface assemblage or driver approach design limits.

Many embodiments of retrofit kits may comprise a controller such as controller 115 of FIG. 1A. Controller 115 may be designed to temporarily or fixed attached to the instrument panel and may comprise wired and/or wireless ports for retrieving sensor data and/or transmitting instructions. In some of the wireless embodiments, a wireless transmitter and receiver is included in the retrofit kit to couple with existing wiring in the instrument panel. The wireless transmitter may be responsive to instructions of controller 115 to provide data to controller 115 or may simply broadcast data periodically.

Several embodiments comprise sensors specifically adapted to work with a controller like controller 115. In some embodiments, the sensors are wireless and/or hardwired via electrical conductors and/or fiber optic filaments. For example, some embodiments comprise a pressure sensor attached to control surface 1005.

Control System

Figure 11:
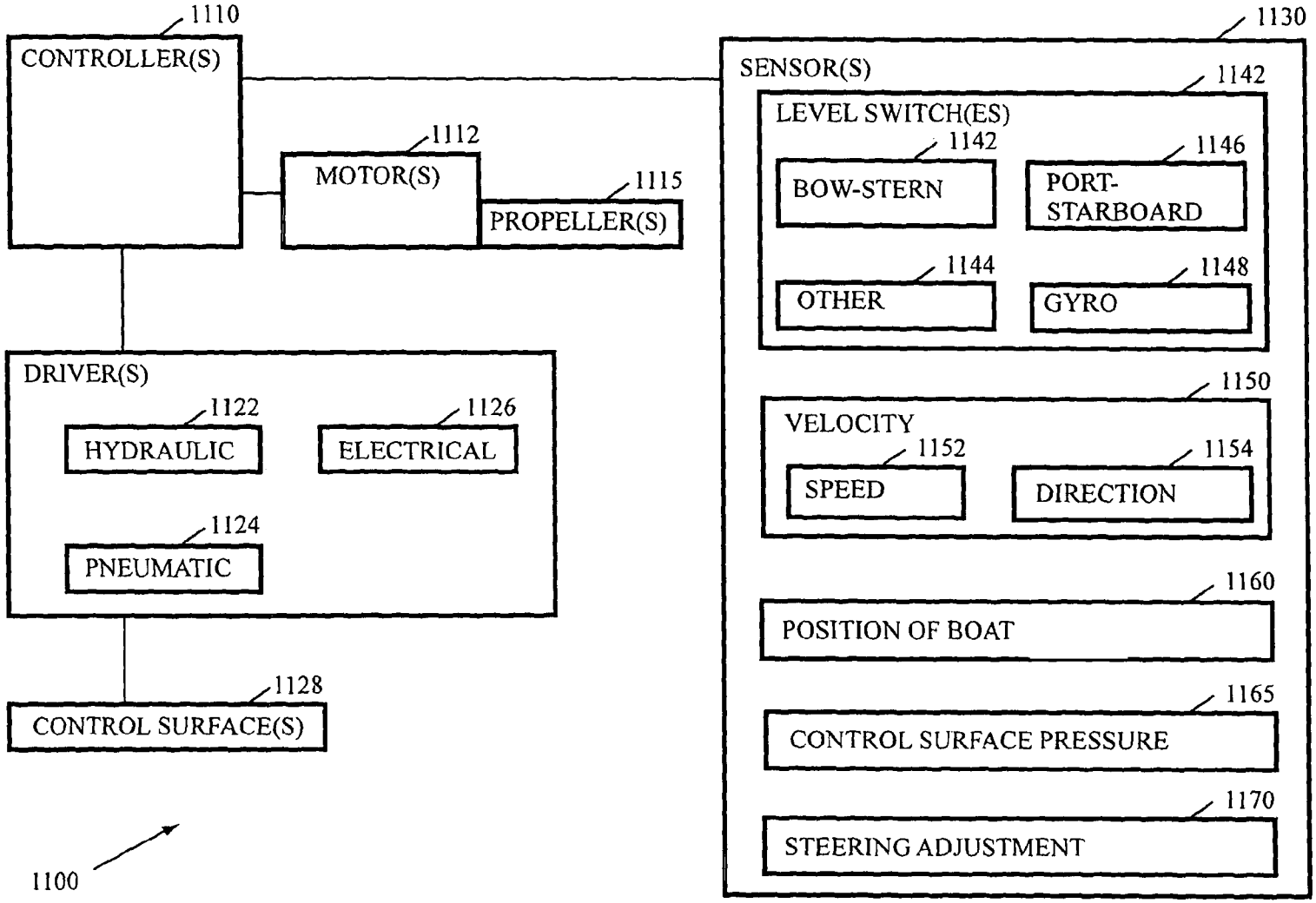
FIG. 11 depicts an embodiment of a control system comprising a sensor, a driver, and a motor to redirect a thrust generated by a propeller to provide a reverse thrust.

Referring now to FIG. 11, there is shown an embodiment of a control system 1100 to redirect a forward thrust generated by a propeller 1115 to provide a non-forward thrust. Control system 1100 comprises a controller(s) 1110, motor(s) 1112, driver(s) 1120, and sensor(s) 1130. Controller(s) 1110 may provide an interface for a boat operator to adjust the position of control surface(s) 1128. More specifically, controller 1110 may accept instructions from the boat operator either directly or via code and data and interpret those instructions into one or more adjustments to the angle of one or more control surface(s) 1128 with respect to one or more propeller(s) 1115 and/or to the distance of one or more control surface(s) 1128 with respect to one or more propeller(s) 1115. For example, the boat operator may pre-program a sequence of turns, each turn being triggered by a consistent action by the boat operator such as turning the steering wheel or pressing a button. Then, when the boat operator wants to initiate the sequence, the boat operator may select the code via controller(s) 1110 and begin turning the steering wheel. Controller(s) 1110 may then enhance steering of the boat by adjusting the angle of one or more of control surface(s) 1128 via driver(s) 1120. In the present embodiment, controller 1110 may adjust the speed of propeller 1115 via a throttle of motor(s) 1112 to facilitate certain maneuvers. The controller may be computerized, or just a linkage to a lever or a power assisted linkage without computerized intervention of the operator selected setting.

Controller(s) 1110 may couple with sensor(s) 1130 to determine adjustments for control surface(s) 1128 and, in some embodiments, when to implement those adjustments. For example, the boat operator may wish to back up into a dock for the boat. The boat may have one reverse gear that provides too much power even when the motor(s) 1112 are at idle to easily maneuver the boat into the dock in reverse. Further, the steering of the boat may be fairly poor when driving the boat in the reverse gear so the boat operator may instruct controller(s) 1110 to produce a reverse thrust in forward gear to provide enhanced steering capabilities. Controller(s) 1110 may respond by applying force to control surface(s) 1128 via driver(s) 1120 and monitoring steering 1170 to dynamically adjust an angle of control surface(s) 1128. Applying the force may insert one or more of control surface(s) 1128 into the prop wash of propeller(s) 1115 to create a component of reverse thrust that is greater than components of forward thrust so the boat is propelled in reverse. Then, by monitoring steering adjustments or changes, and tracking those changes with complimentary changes in the horizontal angles of one or more of control surface(s) 1128, controller(s) 1110 may advantageously provide the boat operator with enhanced maneuverability.

In the present embodiment, controller(s) 1110 may be adapted to interface with motor(s) 112 to adjust the forward and/or reverse thrust provided by propeller(s) 1115. For example, the boat operator may instruct controller(s) 1110 to maintain a specific speed and controller(s) 1110 may interface with motor(s) 1112 to turn off or on one or more motors(s) to adjust the speed of the boat. Controller(s) 1110 may also adjust the RPMs of one or more of motor(s) 1112 in addition to adjusting the position of control surface(s) 1128 to maintain that speed while maintaining the boat substantially level with the water line. Further, controller(s) 1110 may monitor the current speed by monitoring, e.g., the control surface pressure 1165 or speed 1152, as well as the heading via direction 1154.

Driver(s) 1120 may couple with controller(s) 1110 to make adjustments to the position of control surface(s) 1128. Driver(s) may comprise a hydraulic system 1122, a pneumatic system 1124 and/or an electrical system 1126. In some embodiments, controller(s) 1110 is designed to work with more than one of driver(s) 1120. In further embodiments, controller(s) 1110 may comprise an interface for one of driver(s) 1120. In still further embodiments, controller(s) 1110 may comprise an interface for other types of drivers that may be adapted to adjust the position of control surface(s) 1128.

Sensor(s) 1130 may provide data to controller(s) 1110 about the current status of the boat such as the level of the boat via level switch(es) 1140, the linear and/or rotational velocity 1150 of the boat, the position of the boat 1160, the control surface pressure 1165 for one or more of control surface(s) 1128, steering adjustments 1170, linear and/or rotational acceleration, inclination, and the like. In fact, some embodiments may comprise a gyroscope or other gyro based sensor. Level switch(es) 1140 may provide controller(s) 1110 with the angle of the boat bow-to-stern 1142, port-to-starboard 1146, and/or other direction 1144 so controller(s) 1110 can maintain an angle indicated by the boat operator. In some embodiments, rather than comprising multiple switches such as mercury switches, level switch(es) 1140 may comprise a gyro based level switch 1148 that provides level data for multiple angles.

Velocity 1150 may comprise one or more sensors to provide data related to the velocity vector of the boat. For example, in some embodiments, velocity 1150 may comprise a compass to sense direction 1154 and speedometer to sense speed 1152. In further embodiments, velocity 1150 may interface with a global positioning system (GPS) to determine the velocity based upon differences in positions of the boat over time intervals.

The position sensor 1160 may comprise a GPS, may triangulate the current position relative to one or more other reference signals and/or may determine the position of the boat relative to a start position based upon calculated changes to the boats position. Steering adjustment sensor 117 may interface with a steering system for the boat such as by coupling to a rudder and measuring the angle of the rudder to determine adjustments in the direction of the boat made by the boat operator.

Controller

Figure 12:
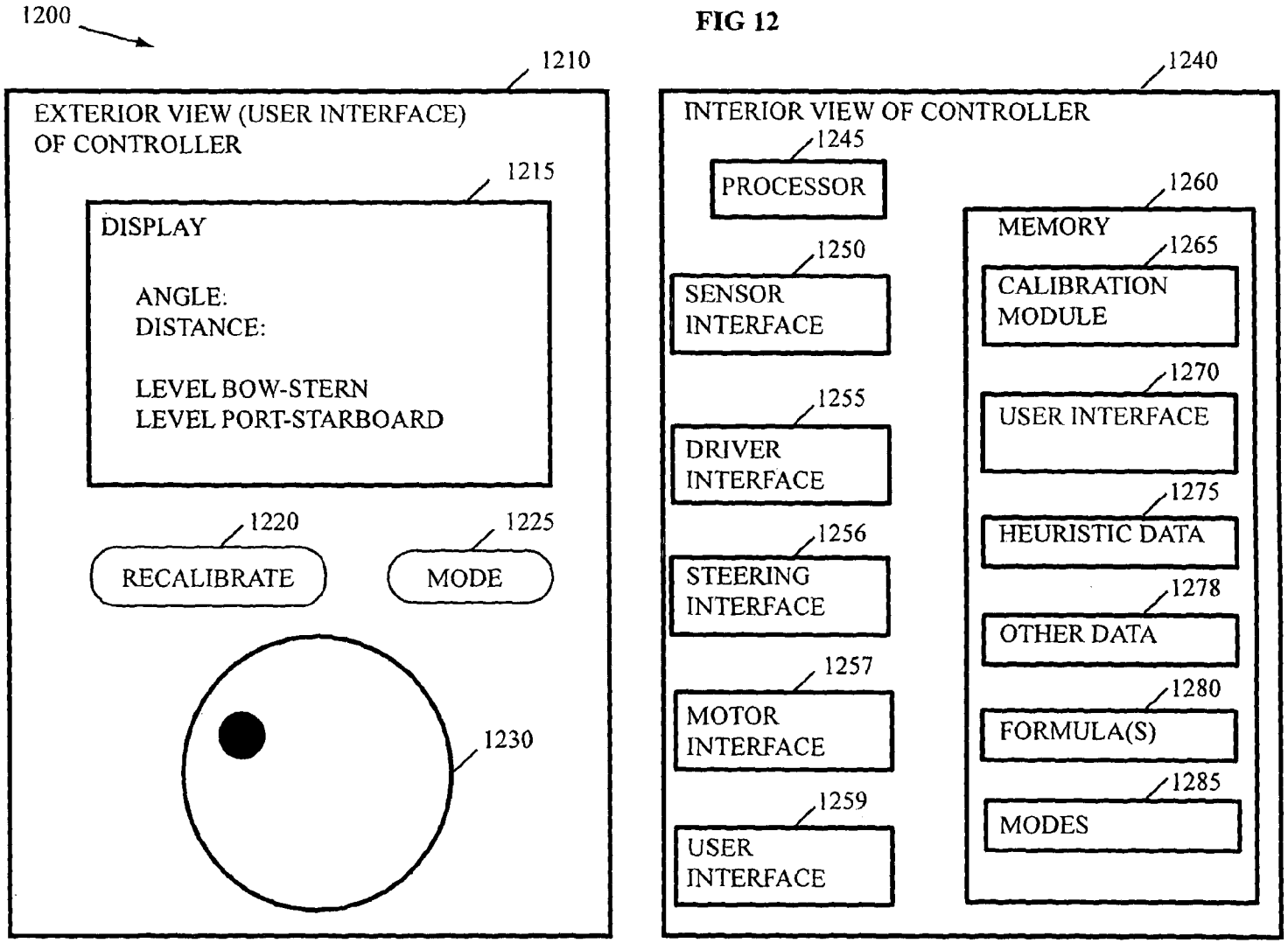
FIG. 12 depicts an embodiment of a controller such as the controller of FIG. 11.

FIG. 12 depicts controller 1200, which may be a more detailed embodiment of controller 1129 of FIG. 11. FIG. 12 depicts an exterior view 1210 and an architectural view 1240 of controller 1200. The exterior view 1210 comprises a display 1215, buttons 1220 and 1225, and wheel 1230. Display 1215 may be adapted to display sensor data such as the angle of control surface 1128, the distance between control surface 1128 and the propeller 1115, degrees off level from bow-to-stern of boat 100, and degrees off level from port-to-starboard of boat 100. In some embodiments, display 1215 may comprise a touch screen or the like adapted to identify pressure in different areas of display via pressure switches, capacitive switches, or other circuitry.

Buttons 1220 and 1225 comprise a recalibrate button 1220 and a mode button 1225. Recalibrate button 1220 may, when activated by the boat operator, initiate a recalibration sequence for controller 1240 and/or sensors coupled with controller 1210. For instance, depressing recalibrate button 1220 may cause processor 1245 to execute recalibration module 1265, causing controller 1200 to reread data from each sensor to determine the position of control surface 1128.

Mode button 1225 may change a mode of controller 1210 in response to activation. Changing the mode of controller 1200 may comprise, e.g., changing the information displayed on display 1215, changing between manual and automatic position updates, entering a customization, modifying speed, modifying control surface angle, modifying a distance between control surface 1128 and propeller 1115, and/or the like. For instance, if mode button 1225 is pressed, controller 1200 may change to the next mode in a sequence of modes. In other embodiments, pressing a button along with mode button 1225 may select a mode or advancement between modes in a different sequence. In further embodiments, buttons 1220 and 1225 may comprise buttons with the same and/or other functions incorporated into controller 1200.

Wheel 1230 may provide a means for adjusting the angle and/or distance of control surface 1128 with respect to propeller 1115. In further embodiments, one mode may facilitate the adjustment of the control surface with respect to a transom of the hull or some other point. For example, the boat operator may press mode button 1225 one or more times to enter a mode to modify the angle of control surface 1128. Once in the mode, display may provide a graphical representation of the angle of control surface 1128 with respect to propeller 1115 as well as a number representing the angle. The boat operator may then dial or turn wheel 1230 to adjust the angle up or down. In some embodiments, one mode may display, e.g., the speed of boat 100 of FIG. 1 as the boat operator adjusts the angle so the boat operator may advantageously monitor the effect of the angle change on the speed of boat 100.

In further embodiments, controller 1200 may allow the boat operator to adjust the speed directly by dialing wheel 1230. For instance, controller 1200 may determine adjustments to the angle and/or position of control surface 1128 to cause the indicated change in speed. In one embodiment, controller 1200 may also interface with the throttle system for boat 100 to modify the speed.

The architectural view 1240 of controller 1200 comprises a processor 1245, a sensor interface, a driver interface 1255, a steering interface 1256, a motor interface 1257, a user interface 1259, and a memory 1260. Processor 1245 may execute code in memory 1260 with data retrieved via sensor interface 1250 and/or stored in memory 1260 to control the position of control surface 1128 in accordance with input from the boat operator. For example, processor 1245 may execute code of user interface 1270 to interact with a boat operator to change the mode of controller 1200 to a mode for adjusting the angle of control surface 1128. User interface 1259 provides the physical level interface for processor 1245 to control display 1215, buttons 1220 and 1225, and wheel 1230. The boat operator may press mode button 1225, user interface 1259 may transmit the input to processor 1245, and, in response, processor 1245 may execute code of user interface 1270 to advance a pointer to point at code for a subsequent mode which may be, e.g., the mode for adjusting the angle of control surface 1128. In other embodiments, part or all of the components in controller 1200 may be implemented with state machines, other hard-coded logic, or the like rather than code and a general-purpose processor. In further embodiments, controller 1200 may implement other features. In still further embodiments, aspects of controller 1200 may be implemented with mechanical switches, cables, pulleys, and/or the like rather than being processor-based.

Sensor interface 1250 may provide interfaces for electrical, fiber optic, hydraulic, pneumatic and/or other types of sensors. Sensor interface 1250 may receive and/or convert data received from sensors for use by processor 1245. In present embodiment, processor 1245 may also execute code of calibration module 1265 to calibrate one or more of the sensors.

Driver interface 1255 provides interfaces for electrical, fiber optic, hydraulic, pneumatic and/or other types of drivers. For example, processor 1245 may instruct a pneumatic system to increase pressure via a valve to control surface(s) 1128 of FIG. 11 to adjust the position of one or more control surface(s) 1128.

Steering interface 1256 may provide a physical interface for a steering system of the boat. For example, steering interface 1256 may provide controller 1210 with an ability to adjust the angle of a rudder. Motor interface 1259 may couple with a motor, which drives a propeller of the boat to provide controller 1210 with an ability to adjust the RPMs of the motor. For instance, for direct current (DC) electric motors, motor interface may output a signal to raise or lower the voltage applied to the motor to adjust the RPMs and torque available. For gas-powered motors, on the other hand, motor interface 1257 may provide control over a throttle or fuel injections to adjust the power output of the gas motor.

User interface 1259 may provide an interface between processor 1245 and display 1215, buttons 1220 and 1225, and wheel 1230. For instance, the boat operator may turn wheel 1230 to rotate a control surface of control surface(s) 1128 about an axis.

Memory 1260 may comprise volatile and non-volatile, and fixed and/or removable memory to store code and data to facilitate adjustment of control surface(s) 1128 by controller 1200. For example, memory may include read only memory (ROM), random access memory (RAM) like dynamic RAM (DRAM), flash, a hard drive, optical media, and/or other data storage. Memory 1260 may comprise calibration module 1265, user interface 1270, heuristic data 1275, other data 1278, formula(s) 1280, mode(s) 1285 and/or the like.

Calibration module 1265 may facilitate calibration of sensors and, in further embodiments, may automatically calibrate sensors by comparing sensed data from one or more sensors against the sensed data from one or more other sensors. More specifically, one or more sensors may be designated or considered accurate or self-calibrated and thus, controller 1200 may trust the data received from those sensors. For example, calibration module 1265 may comprise code for execution by processor 1245 that monitors a speedometer and calibrates the pressure sensor(s) 1165 for control surface(s) 1128. In a further embodiment, calibration module 1265 may monitor a calibration of the sensed position of the propeller based upon changes in propulsion responsive to the redirected thrust. For instance, the angle read for the control surface may not be consistent with the port-to-starboard tilt or the change in course recorded by a GPS so the calibration module 1265 may determine the actual position of a control surface based upon the tilt and/or the GPS data to calibrate the sensor that detects the position of the control surface.

User Interface 1270 may comprise code, which, upon execution by processor 1245, is adapted to provide instructions to user interface 1259 to display information on display 1215 and receive input from the boat operator via buttons 1220 and 1225, and wheel 1230. In further embodiments, display 1215 may comprise a touch screen or the like and user interface 1270 may comprise code to interpret pressure applied by the boat operator to various portions of display 1215.

Heuristic data 1275 may comprise data collected by controller 1200 to facilitate accurate adjustment of the position of control surface(s) 1128. For instance, heuristic data 1275 may comprise data related to, e.g., speed of the boat resulting from use of a propeller at certain RPMs and the pressure indicated by the control surface at different speeds and different angle. In some embodiments, a boat operator may also separately store data collected from use of the boat in different bodies of water, or even different areas of a body of water so the data may more accurately account for particulates in the water. In further embodiments, the heuristic data 1275 may be provided with controller 1200 and related to test data taken via the same type of boat, a similar boat, or a typical boat.

Other data 1278 may comprise data provided with controller 1200 or the boat upon which controller 1200 is to be installed. Other data 1278 may comprise theoretical data, constants, conversion factors, and/or further data selected to facilitate use of controller 1200 and the included code and/or logic by the boat operator. Other data 1278 may also comprise data indicating preferences of one or more boat operators.

Formulas 1280 may comprise one or more formulas provided with controller 1200 to calculate theoretical values for, e.g., the anticipated control surface position to cause the boat to turn within a particular radius. Formulas 1280 may further comprise formulas to dynamically calculate corrections for the position of control surface(s) 1128 to correct the course, pitch, tilt, roll, and/or the wake size and shape created by the boat based upon sensor data that is available to and/or may be available as an optional accessory for controller 1200.

Modes 1285 may comprise code to provide one or modes of use for controller 1200. For instance, one mode available to a boat operator may display an angle and distance for control surface(s) 1128 as values and another mode may display a two-dimensional or three-dimensional representation of the angle and distance of control surface(s) 1128. Some modes may allow the boat operator to adjust, e.g., the position of control surface(s) 1128 while displaying the effect of the changes on speed, an angle of the boat, or other. Further modes may allow the boat operator to execute code for dynamically controlling the boat. For example, one mode may cause controller 1200 to dynamically maintain the speed of the boat by adjusting the position of the control surface and/or the throttle for the motor. Many other modes are also contemplated.

Drivers

Figure 13A:
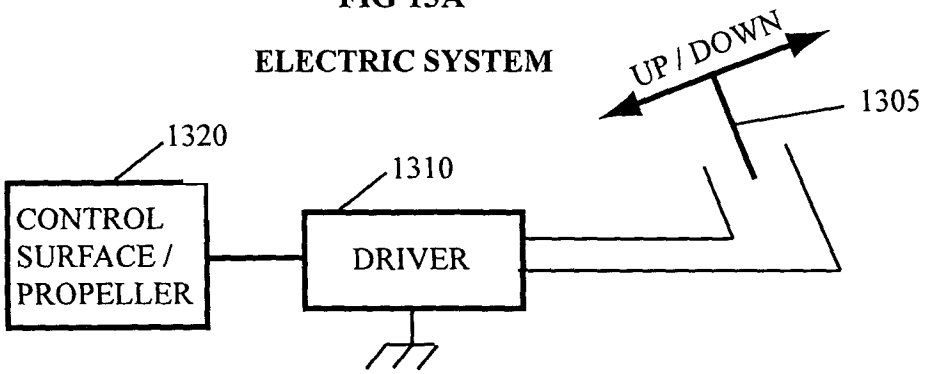
FIGS. 13-14 depict embodiments of electric, pneumatic, and hydraulic drivers, respectively, that are adapted to adjust the position of control surfaces such as the control surface(s) in FIG. 11.
Figure 13B:
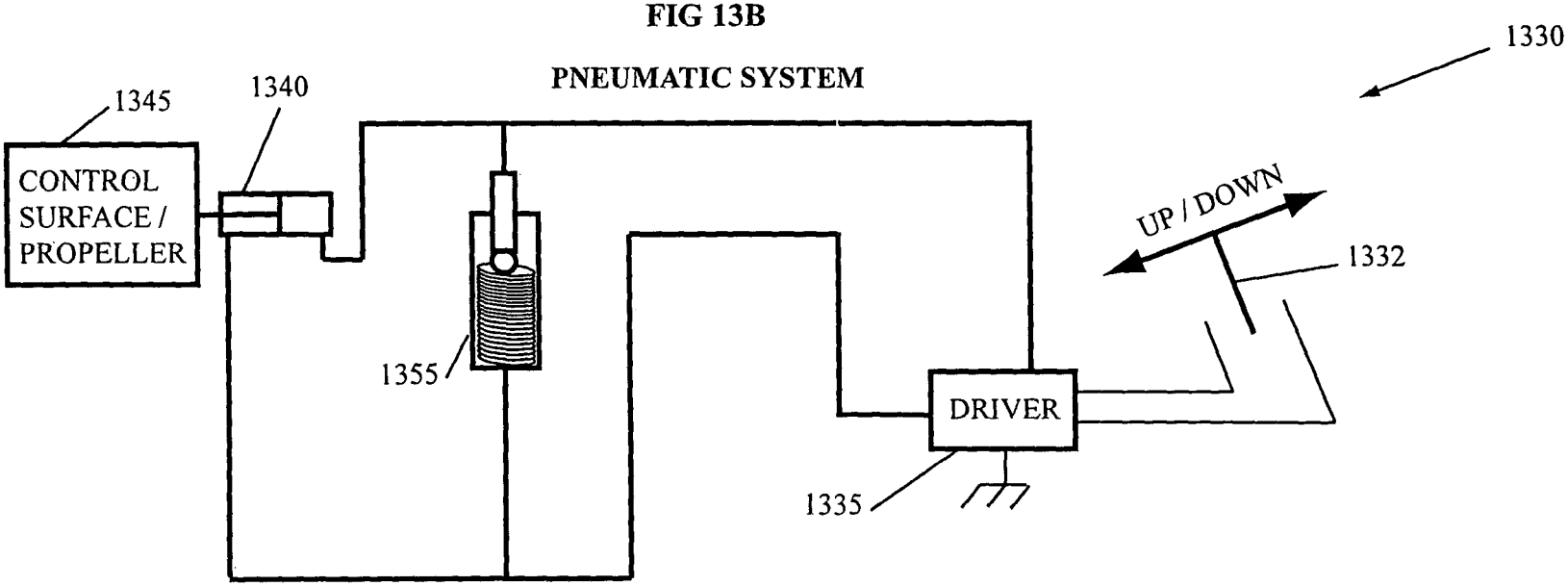
Figure 14:
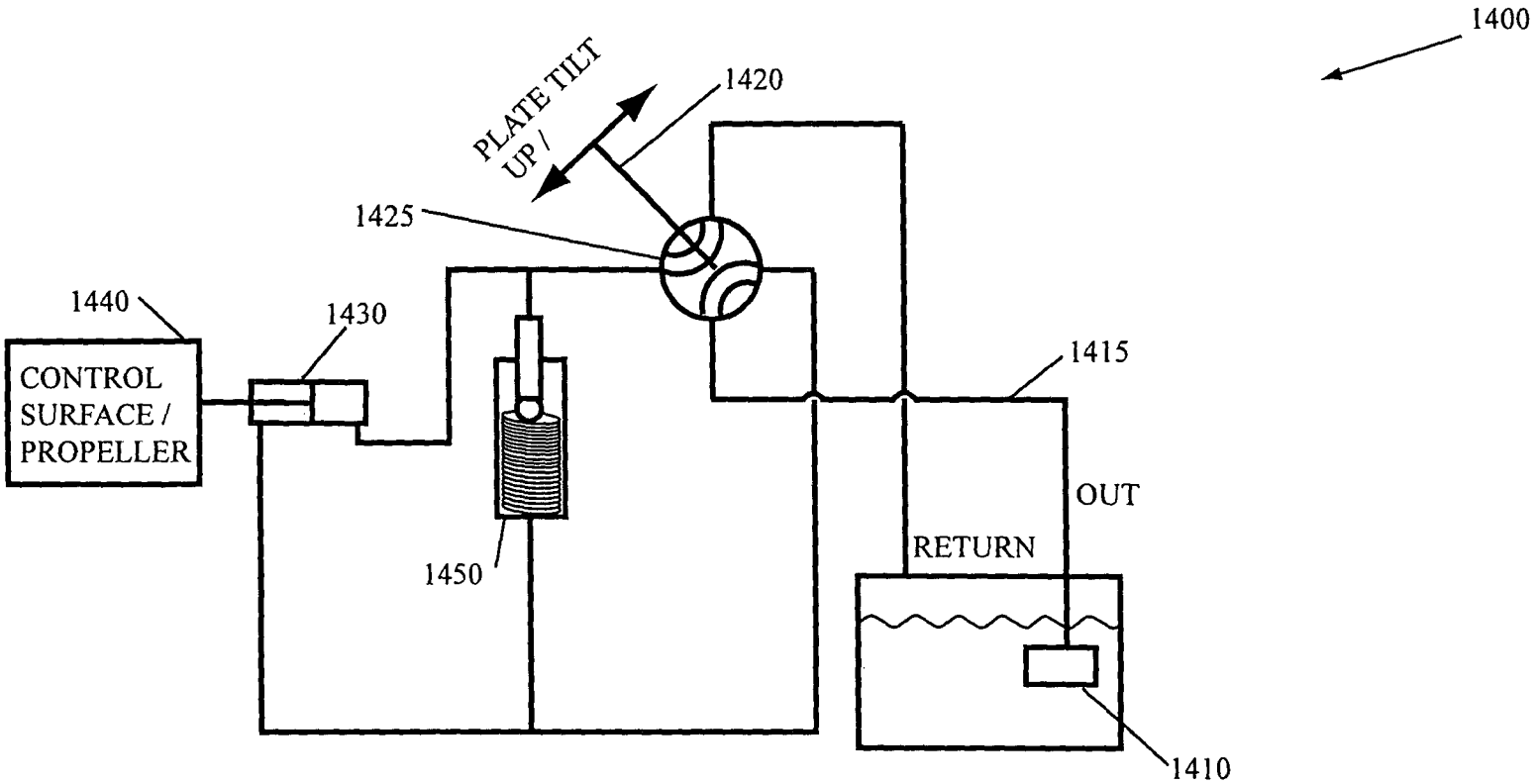

FIGS. 13-14 depict embodiments of electric, pneumatic, and hydraulic drivers, respectively, adapted to adjust the spatial relationship of a control surface and propeller. The embodiments depict only one control surface/propeller and one control lever to adjust the spatial relationship for clarity. However, embodiments may move/reorient one or more control surfaces such as control surfaces and/or adjust the position of one or more propellers and each system may be adapted to provide adjustment for the distance and/or the angle of the control surface with respect to the propeller in one or more different planes by adding more controls as will be obvious to those of ordinary skill in the art based upon this disclosure.

FIGS. 13A-B depict embodiments comprising electric motors that may run off battery power, an alternator coupled with a gas-powered motor, or the like. In particular, FIG. 13A depicts an electric system 1300 with a direct current (DC) motor 1310. In other embodiments, motor 1310 may be an alternating current (AC) motor. In several of these embodiments, a DC-to-AC converter may couple with a power system for a boat to power motor 1310.

A control lever 1305, such as wheel 1230 of FIG. 12, may adjust the magnitude of the voltage applied to DC motor 1310. For example, applying a positive 12 volts to motor 1310 may cause DC motor 1310 to begin adjusting control surface/propeller 1320 upward. Further, applying a negative 12 volts to DC motor 1310 may begin adjusting control surface/propeller 1320 downward. In further embodiments, applying a low positive voltage may lengthen an arm coupled with control surface/propeller 1320 to adjust control surface/propeller 1320 upward and applying a large positive voltage to DC motor 1310 may lengthen an arm coupled with control surface/propeller 1320 to adjust control surface/propeller 1320 downward. In still further embodiments, applying a voltage to DC motor 1310 may increase or reduce the distance between the control surface and the propeller. Many other arrangements for one or more DC motors, solenoids, and/or the like are contemplated.

FIG. 13B depicts an embodiment of a pneumatic system 1330 with a control lever 1332 for modifying the position of control surface/propeller 1345. For example, applying a positive 12 volts to compressor 1335 may increase the air pressure in system 1330. Compressor 1335 may comprise a reservoir to store compressed air and the reservoir couples compressor 1335 with the remainder of system 1330. Increasing the pressure forces arm 1340 to extend to a point related to the increase and then the compressed air substantially maintains the position of the arm against forces applied to control surface/propeller 1345. Extending adjustable arm 1340 may turn control surface/propeller 1345 upward. If control surface/propeller 1345 is a plate and is spring loaded to maintain the plate perpendicular to a propeller, the boat operator may have to apply a certain voltage to control surface/propeller 1345 to maintain the pressure necessary to maintain the new position of control surface/propeller 1345. Then, by reducing the voltage, control surface/propeller 1345 may start turning back toward the perpendicular position. In such embodiments, applying a negative voltage may turn control surface/propeller 1345 downward. A relief valve 1355 may release air to reduce the pressure in the system 1330 in case the pressure rises toward or to the maximum rated pressure of system 1330.

In many embodiments, a default position adjusts the spatial relationship of the control surface and the propeller to direct the prop wash away from the control surface as a fail-Safe. In particular, even the power system fails but the motor for the propeller still runs, the boat can maneuver back to dock without the assistance of the control surface. Many other arrangements are also contemplated.

FIG. 14 depicts an embodiment of a hydraulic system 1430 for modifying the spatial relationship of the control surface with respect to the propeller. Pump 1410 is adapted to adjust the pressure within system 1400 via hydraulic line 1415 and the position of valve 1425 determines the direction in which pressure is applied to arm 1430 as well as the magnitude of the pressure. Applying a positive pressure, when valve 1425 is in the position shown, may turn control surface/propeller 1440 upward. Twisting control lever 1420 may isolate arm 1430 from pump 1410 to maintain pressure on control surface/propeller 1440 to maintain the position of control surface/propeller 1440 substantially at the moment the control lever 1420 is turned via hydraulic fluid in arm 1430.

Rotating control lever further may apply the opposite pressure on arm 1430 and turn control surface/propeller 1440 downward. A relief valve 1450 may allow the hydraulic fluid to escape into a reservoir to reduce the pressure in the system 1400 in case the pressure rises toward or to the maximum rated pressure of system 1400. For example, if an object impacts control surface/propeller 1440, the pressure in system 1400 may have a significant spike. Release valve 1450 may respond by releasing hydraulic fluid into the reservoir. Many other arrangements are also contemplated.

Databases

Figure 15A:
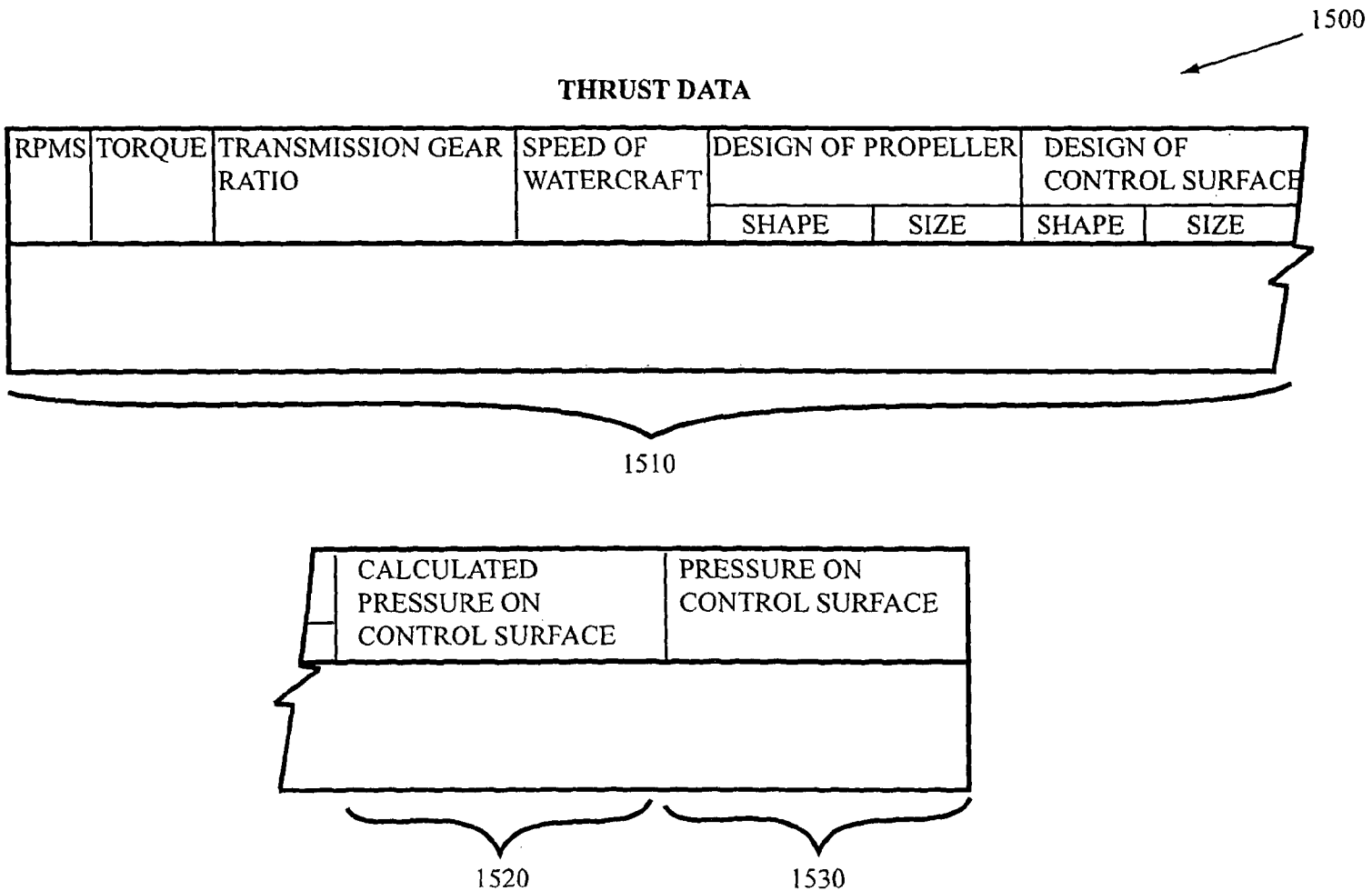

Referring now to FIGS. 15A-B, there is shown an embodiment of a data structure 1500 to redirect a thrust generated by a propeller by adjusting a spatial relationship between the propeller and a control surface for a watercraft. FIG. 15A depicts an embodiment of a database to facilitate determination of thrust. In the present embodiment, the thrust determination focuses on a determination of the pressure on the control surface at different speeds as well as an ability to modify the thrust as a result of the torque available at different RPMs in different gears.

Columns 1510 provide data related to the motor, transmission, propeller, and control surface to calculate a theoretical thrust perceived by the control surface at different speeds. More specifically, RPMs determine how fast the propeller displaces water and the speed of the watercraft may determine the amount of resistance that is added due to the impact of water from water flow passed the boat rather than embodying the thrust generated by the propeller. The torque and transmission gear ratio provide an indication of the ability to change the speed. For instance, a controller may utilize the torque and transmission gear ratio to determine how much adjustment should be made to the throttle of the motor to maintain a constant speed.

The design of the propeller in terms of shape determines the quantity of water propelled by the propeller. For example, the propeller may comprise a single set of blades or more then one set of blades. One common propeller, often referred to as a dual propeller, comprises two sets of three blades. While requiring a greater torque from the motor at a particular RPMs, the propeller generates a greater magnitude of thrust.

The size or diameter of the propeller determines the diameter of the water column propelled by the propeller and the design of the control surface including the size and shape determines the portion of the water column that impacts the control surface, the portion of the surrounding water flow that impacts the control surface (providing a component of reverse thrust), and the net magnitude and direction of the redirected thrust.

Column 1520 comprises the calculated pressure on the control surface based upon the given variables in columns 1510. In some embodiments, the manufacturer of the controller or the author of the database determines a single watercraft design or a smaller set of watercraft designs, essentially fixing one or more of the variables described in columns 1510.

Column 1530 comprises heuristic data determined from use of a boat. In many embodiments, after the database is installed on a boat, the controller of the boat begins to populate column 1530 based upon actual use of the boat, customizing the database to the boat operator and the locations in which the boat is typically used. In some embodiments, the data is continually updated as different data is identified. In further embodiments, the heuristic data is repeatedly averaged with newer data.

FIG. 15B depicts an embodiment for a data structure 1540 for propulsion data and a data structure for control surface adjustment formulas 1550. The propulsion data describes a net thrust on the control surface and the angle of the control surface with respect to the propeller so the redirected components of thrust perceived by the control surface can be determined. The hull design column may provide a factor related to the relative friction of the hull against the water and the weight provides a factor in determining the change in speed of the boat based upon a change in the thrust.

The control surface adjustment formulas 1550 provide a number of formulas for determining an adjustment for the position of the control surface with respect to the propeller. Other embodiments may comprise one or more formulas similar to one or more of these formulas or another formula. In particular, control surface adjustment formulas comprise an interpolator column. The interpolator column comprises data that provides typical adjustments based upon the net thrust and the angle of the control surface with respect to the thrust generated by the propeller. If the data for the specific angle and/or net thrust is not available, the controller may interpolate the data to determine an adjustment. In many of these embodiments, the controller may comprise a module to monitor the result of the adjustment and dynamically adjust or fine-tune the angle of the control surface with respect to the propeller to attain the desired result. For instance, the module may monitor rotational or angular acceleration and/or velocity, linear acceleration and/or velocity, speed, and the like to compare against the thrust to adjust the angle and/or position of the control surface.

The second column of the control surface adjustment formulas 1550 provides one or more formulas as an alternative method to determine the adjustment. For example, different formulas may be available for different net thrusts, angles of the control surface, hull designs, weights, and/or other available information.

The third column of the control surface adjustment formulas 1550 provides one or more curve fitting formulas that may determine the adjustment for the position of the control surface based upon the heuristic data for the control surface pressure in column 1530 of FIG. 15A and the angle of the control surface with respect to the propeller.

Other embodiments may comprise more or less information, which may affect the accuracy of the initial determination for the angle adjustment. For example, one embodiment may also comprise an indication of the weight distribution of the watercraft.

Flow Charts

Figure 16:
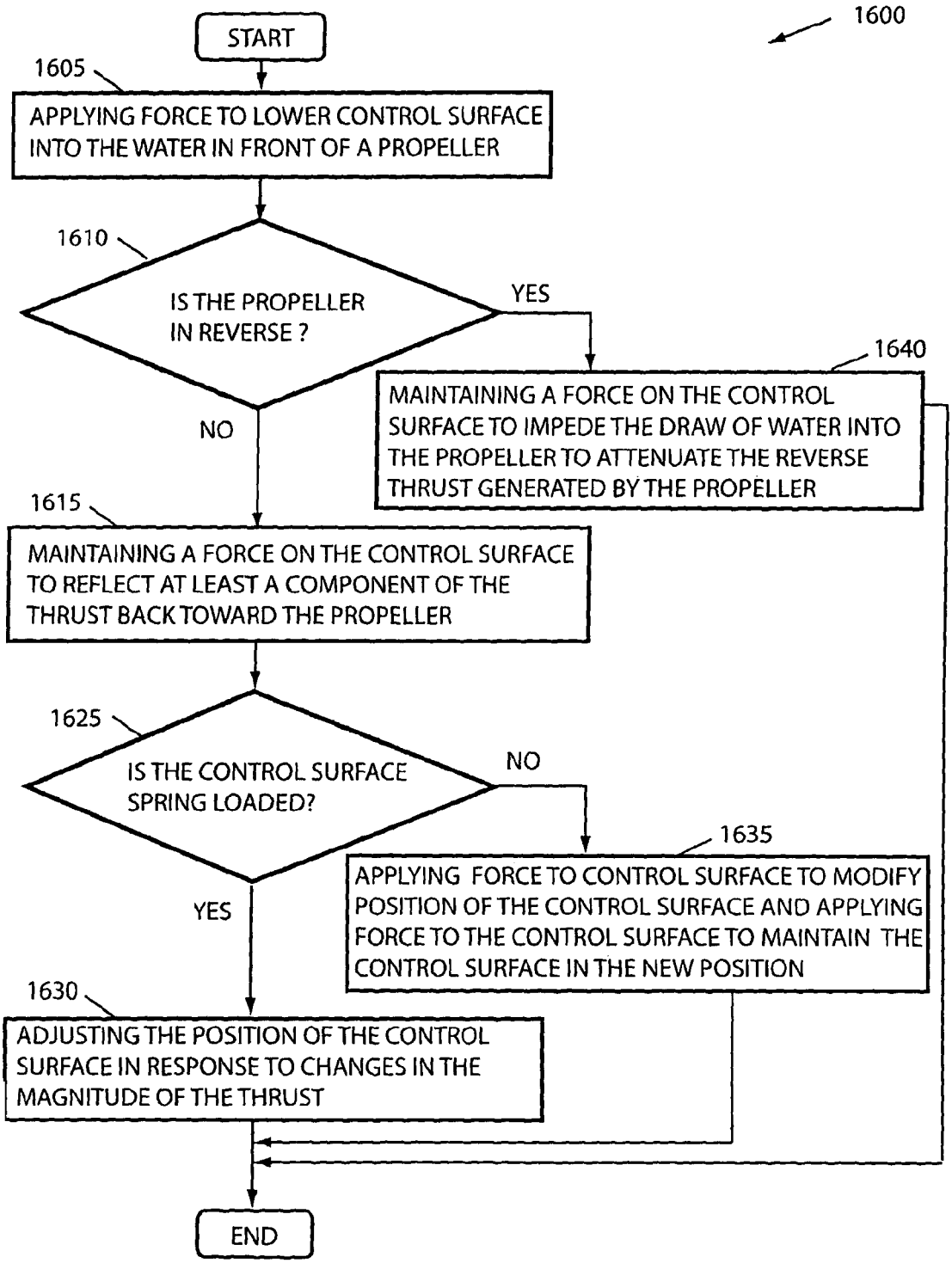
FIG. 16 depicts a flow chart of an embodiment adapted to redirect a thrust generated by a propeller via a control surface for a watercraft and to reduce the magnitude of the thrust while the motor is idling to provide greater control over the thrust to the boat operator.

Referring now to FIG. 16, there is shown a flow chart 1600 of an embodiment adapted to redirect a thrust generated by a propeller via a control surface for a watercraft and to reduce the magnitude of the thrust while the motor is idling to provide greater control over the thrust to the boat operator. Flow chart 1600 illustrates actions of a mechanism that may be attached to a watercraft like FIGS. 1A, 6A, and 8A. Flow chart 1600 begins with applying force to lower a control surface into the water in front of a propeller (element 1605). For example, a spring-loaded hinge may lower a control surface into the water in front of the propeller of the boat to adjust the position of control surface in the prop wash of a propeller to generate a component of reverse thrust for a forward thrust and to impede the flow of water drawn into the propeller when the propeller generates a reverse thrust. In other embodiments, the propeller shaft may be moved instead of or in addition to movement of the control surface to adjust the spatial relationship between the control surface and the propeller.

If the boat operator shifts the boat into reverse, reversing the direction of the propeller (element 1610), the spring-loaded hinge may maintain a force on the control surface to impede the draw of water into the propeller to attenuate the reverse thrust generated by the propeller (element 1640). For instance, the hinge may be adapted to allow substantially little movement by the control surface toward the propeller to prevent the control surface from damaging the propeller and vice versa. The hinge should be capable of applying a force that is at least as great as the reverse thrust.

On the other hand, if the propeller is generating a forward thrust rather than a reverse thrust (element 1610), a force may be applied to the control surface to reflect at least a component of the thrust back toward the propeller. In some embodiments, the force may be applied via a spring. In further embodiments, the force may be applied via an arm such as an adjustable length arm. If the hinge is spring-loaded (element 1625), the spring may compress in response to an increase in forward thrust, allowing the control surface to transition into a new position, which is based upon the loading characteristic of the spring and the magnitude of the thrust (element 1630).

In several embodiments, the length of one or more adjustable arms and/or the tension on one or more cables may determine the position of the control surface and the hinge may not be spring-loaded (element 1625). In such embodiments, the boat operator may manually with or without powered assist adjust the length of the arm(s) or tension on the cable(s), or a controller may implement the changes for the boat operator. Force may be applied to the control surface as a result, to modify the position of the control surface and maintain the control surface in the new position (element 1635).

In other embodiments, the hinge may be spring-load and the adjustable arm or cable may compliment the force of the spring to determine whether to move the control surface. For instance, a cable may pull the control surface, reducing the net force applied to the control surface to counteract the thrust. In such situations, the control surface may move in a linear or angular motion away from the thrust. On the other hand, an arm may be lengthened to apply force that adds to the force applied to the spring to move the control surface toward the propeller. In such situations, the control surface may either move closer to the propeller or maintain its current position.

Figure 17:
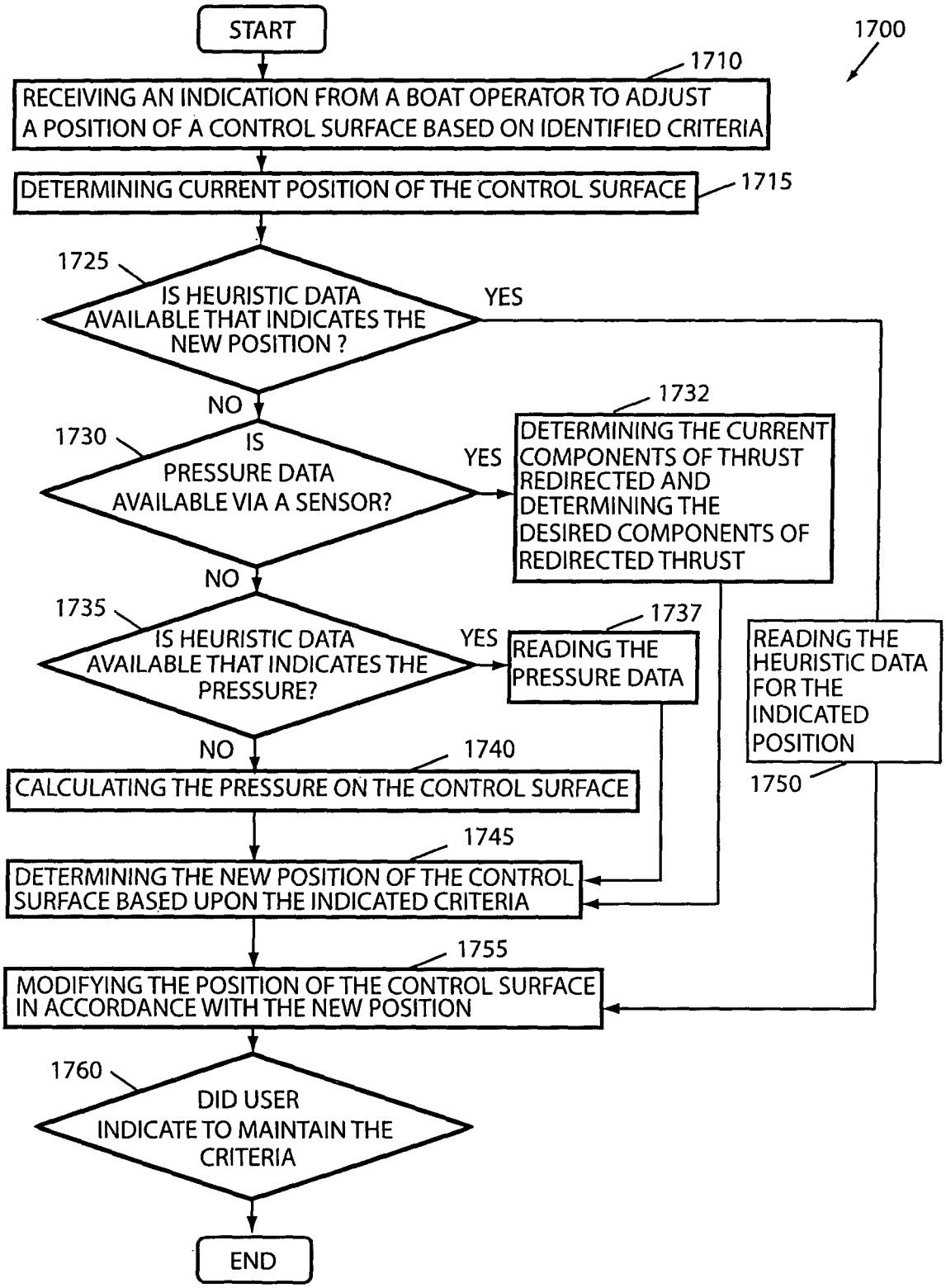
FIG. 17 depicts a flow chart of an embodiment of a controller such as the controller of FIG. 1A, which is adapted to adjust the magnitude of or redirect the thrust to provide greater control over the thrust to the boat operator.

Referring now to FIG. 17, there is shown a flow chart 1700 of an embodiment of a controller such as controller 115 of FIG. 1A, which is adapted to adjust the magnitude of or redirect the thrust to provide greater control over the thrust to the boat operator. Flow chart 1700 begins with receiving an indication from a boat operator to adjust a position of a control surface based upon identified criteria (element 1710). For example, the boat operator may instruct the controller to, e.g., maintain the level of the boat bow-to-stern and port-to-starboard to be substantially parallel with the water line. In response, the controller may enter a mode to dynamically compensate for changes in the level of the boat. For instance, the controller may compensate for environmental conditions such as wind, currents, waves, or the like, and/or actions by the boat operator such as steering the boat to port or to starboard. Other criteria may comprise other angles of the boat, the speed of the boat, a specified course for the boat, a wake shape to be created by the boat, and/or any other characteristic that is adjustable by redirecting thrust generated by the propeller and/or attenuating thrust generated by the propeller.

In response to the indication from a boat operator to adjust a position of a control surface based upon identified criteria, the controller determines the current position of the control surface (element 1715) and then determines an adjustment to the position of the control surface, if any, to maintain the criteria. Determining the current position of the control surface may comprise reading and interpreting indications of sensors. For instance, rotatable joints may comprise a sensor that provides an indication of the extent of the rotation and arms having adjustable lengths may couple with sensors adapted to provide the length of the arm. In further embodiments, the sensors provide relative angles or distances, or changes in angles and distances. In such embodiments, the controller may interpret the data to track the current position of the control surface. In some of these embodiments, the controller may calibrate the position of the control surface by allowing the force of one or more springs to return the control surface to a known position and determining correction factors for the readings from the sensors.

Based upon the current position of control surface, the controller may determine an adjustment for the position of the control surface. For example, if the boat operator turns to boat to port and the controller is attempting to maintain the port-to-starboard angle of the boat substantially parallel to the water line, the controller may modify the angle of the control surface with respect to the thrust to reflect a component of the thrust to port to counteract the tendency of the boat roll toward the port during the turn.

In some embodiments, the controller may comprise heuristic data from a similar turn at a similar speed that indicates the new position for the control surface or an adjustment for the position of the control surface. If the heuristic data is available (element 1725), the data is read (element 1750) and the controller modifies the position of the control surface in accordance with the new position.

If pressure sensor data is available via a sensor for the control surface (element 1730), further embodiments may read the pressure data to determine the current components of thrust redirected by the control surface and determine the desired components of redirected thrust (element 1732). Then, the controller may modify the angle of the control surface with respect to the propeller or the distance of the control surface from the propeller based upon the desired components of thrust (element 1745).

If no pressure sensor data is available, the controller may read and/or interpolate data from heuristic data that indicates pressure on the control surface under the similar conditions such as the speed, the turning radius of the boat, the angles of the boat port-to-starboard and/or bow-to-stern, and/or the like. If the heuristic data is available (element 1735), the controller may read the pressure data (element 1737) and determine the new position of the control surface based upon the criteria.

If no pressure data is available, the controller may calculate a theoretical pressure on the control surface (element 1740) based upon formulas or logic provided to the controller to determine components of redirected thrust. The controller may then determine the new position of the control surface to provide the desired components of redirected thrust (element 1745).

The controller may determine the change in the current position based upon the current components of redirected thrust modify the position of the control surface accordingly (element 1755). If the criterion indicated by the boat operator represents a request for repeated or periodic adjustments, the controller may continue to monitor whether the position of the control surface should be adjusted and repeat the above elements as necessary.

One embodiment of the invention is implemented as a program product for use with a computer system such as, for example, the system 100 shown in FIG. 1A. The program(s) of the program product defines functions of the embodiments (including the methods described herein) and can be contained on a variety of signal-bearing media. Illustrative signal-bearing media include, but are not limited to: (i) information permanently stored on non-writable storage media (e.g., read-only memory devices within a computer such as CD- ROM disks readable by a CD-ROM drive); (ii) alterable information stored on writable storage media (e.g., hard-disk drive or floppy disks within a diskette drive); and (iii) information conveyed to a computer by a communications medium, such as through a computer or telephone network, including wireless communications. The latter embodiment specifically includes information downloaded from the Internet and other networks. Such signal-bearing media, when carrying computer-readable instructions that direct the functions of the present invention, represent embodiments of the present invention.

In general, the routines executed to implement the embodiments of the invention, may be part of an operating system or a specific application, component, program, module, object, or sequence of instructions. The computer program of the present invention typically is comprised of a multitude of instructions that will be translated by the native computer into a machine-readable format and hence executable instructions. Also, programs are comprised of variables and data structures that either reside locally to the program or are found in memory or on storage devices. In addition, various programs described hereinafter may be identified based upon the application for which they are implemented in a specific embodiment of the invention. However, it should be appreciated that any particular program nomenclature that follows is used merely for convenience, and thus the invention should not be limited to use solely in any specific application identified and/or implied by such nomenclature.

It will be apparent to those skilled in the art having the benefit of this disclosure that the present invention contemplates redirecting a thrust generated by a propeller via a control surface for a watercraft to provide greater control over the thrust to the boat operator. It is understood that the form of the invention shown and described in the detailed description and the drawings are to be taken merely as examples. It is intended that the following claims be interpreted broadly to embrace all the variations, and, logical combinations of the example embodiments disclosed.

What is claimed is:

1. An apparatus to redirect a thrust generated by a propeller for a watercraft, comprising:

a control surface to redirect the thrust from the propeller based upon a position of the control surface with respect to the propeller, wherein the redirected thrust comprises a component of non-forward thrust;

a first member to couple with the watercraft and the control surface to maintain a distance between the control surface and the propeller to position the control surface at least partially within an area in which prop wash is to be expelled by the propeller; and an adjustable member to couple with the first member to rotate the first member to move the control surface between different positions within the area in which prop wash is to be expelled by the propeller to generate a net thrust to steer the watercraft, wherein the first member comprises a rigid member and the apparatus further comprises a non-rigid joint to couple the rigid member with the control surface to restrict movement of the control surface in at least one direction, further comprising a spring coupled between the rigid member and the control surface, wherein the spring is adapted to apply the force to the control surface to maintain the control surface at least partially within the prop wash at least until a magnitude of the thrust reaches a threshold magnitude based upon a loading curve of the spring, which allows the control surface to disengage.

2. An apparatus to redirect a thrust generated by a propeller for a watercraft, comprising:

a control surface to redirect the thrust from the propeller based upon a position of the control surface with respect to the propeller, wherein the redirected thrust comprises a component of non-forward thrust;

a first member to couple with the watercraft to apply force to adjust a spatial relationship between the control surface and the propeller to position the control surface at least partially within an area in which prop wash is to be expelled by the propeller, wherein the first member comprises a rigid member;

a non-rigid joint to couple the rigid member with the control surface to restrict movement of the control surface in at least one direction, wherein the non-rigid joint is adapted to rotate the control surface between a first position in which the control surface is substantially perpendicular to the thrust and a second position in which the control surface is substantially parallel to the thrust, wherein positions between the first position and the second position and the shape and size of the control surface are adapted to sufficiently redirect the thrust generated by the propeller to provide a variable, net reverse thrust responsive to the thrust generated by the propeller;

a spring coupled between the rigid member and the control surface, wherein the spring is adapted to apply the force to the control surface to maintain the control surface at least partially within the prop wash at least until a magnitude of the thrust reaches a threshold magnitude based upon a loading curve of the spring, which allows the control surface to disengage, wherein the position, shape, and size of the control surface and a loading characteristic of the spring are adapted to sufficiently redirect the thrust generated by the propeller to provide a variable, net reverse thrust responsive to the thrust generated by the propeller; and an adjustable member to couple with the control surface adapted to provide force via a driver in addition to the force applied via the spring to adjust rotation of the control surface between the first position and the second position, the adjustable member to hold the control surface at the first position, the second position, and the positions between the first position and the second position.

3. The apparatus of claim 2, further comprising a second adjustable member and a second control surface to couple with the second adjustable member to operate in conjunction with the control surface to generate the net thrust.

4. The apparatus of claim 3, wherein the control surface comprises two distinct control plates to couple with the adjustable member to operate in conjunction to generate the net thrust.

5. The apparatus of claim 2, wherein the control surface comprises two distinct control plates to couple with the adjustable member to operate in conjunction to generate the net thrust.

6. The apparatus of claim 2, wherein the control surface comprises two distinct rudders.

7. The apparatus of claim 2, wherein the control surface comprises two distinct control plates to couple with the first member to operate in conjunction to generate the component of non-forward thrust.

8. The apparatus of claim 2, further comprising a second member and a second control surface to couple with the second member to operate in conjunction with the control surface to generate the component of non-forward thrust.

9. An apparatus to redirect a thrust generated by a propeller for a watercraft, comprising:

a control surface to redirect the thrust from the propeller based upon a position of the control surface with respect to the propeller, wherein the redirected thrust comprises a component of non-forward thrust; and a first member to couple with the watercraft to apply force to adjust a spatial relationship between the control surface and the propeller to position the control surface at least partially within an area in which prop wash is to be expelled by the propeller, wherein the first member couples with the control surface and a release mechanism to prevent damage when stresses on the apparatus related to redirecting thrust approach design limits, wherein the first member couples with an overload release valve to reduce hydraulic pressure in a hydraulic system when the hydraulic pressure approaches design limits of the hydraulic system.

10. The apparatus of claim 9, wherein the first member is adjustable and adapted to apply force to the control surface to adjust a distance between the control surface and the propeller, wherein the first member is capable of adjusting the distance between the control surface and the propeller to adjust a magnitude of the net thrust independently from adjustment of an angle of the control surface with respect to the propeller.

11. The apparatus of claim 9, further comprising an adjustable member to couple with the control surface to operate in conjunction with the first member, the adjustable member to substantially adjust the position of the control surface to generate a net thrust that changes the orientation or steers the watercraft, wherein the adjustable member is adapted to apply an angular force to the control surface to adjust an angle of the control surface, which adjusts the angle of impact of the thrust on the control surface.

12. The apparatus of claim 9, wherein the control surface comprises a plate with a bent edge.

13. The apparatus of claim 12, wherein the bent edge of the control surface comprises a rounded shape.

14. The apparatus of claim 12, wherein the bent edge of the control surface comprises an angular shape.

15. The apparatus of claim 9, wherein the control surface and the first member comprise at least part of a retrofit kit.

16. The apparatus of claim 9, wherein the first member comprises a rigid member and the apparatus further comprises a non-rigid joint to couple the rigid member with the control surface to restrict movement of the control surface in at least one direction.

17. The apparatus of claim 9, further comprising a joint to couple the first member with the watercraft via an outboard motor.

18. The apparatus of claim 9, further comprising a joint to couple the first member with a stern drive of the watercraft.

19. The apparatus of claim 9, wherein the first member comprises an arm adapted to limit movement of the control surface in at least one direction.

20. The apparatus of claim 9, wherein the first member couples with the control surface via a overload spring to prevent damage when stresses on the apparatus related to redirecting thrust approach design limits.

21. An apparatus to redirect a thrust generated by a propeller for a watercraft, comprising:

a control surface to redirect the thrust from the propeller based upon a position of the control surface with respect to the propeller, wherein the redirected thrust comprises a component of non-forward thrust; and a first member to couple with the watercraft to apply force to adjust a spatial relationship between the control surface and the propeller to position the control surface at least partially within an area in which prop wash is to be expelled by the propeller, wherein the first member is adapted to couple with a rudder of the watercraft to maintain alignment of an axis of rotation for the control surface with an axis of rotation for the propeller.

22. A method to redirect a thrust generated by a propeller via a control surface for a watercraft, the method comprising:

applying force via a first member to adjust a spatial relationship between the control surface and the propeller to position the control surface at a position at least partially within an area in which prop wash is to be expelled by the propeller;

redirecting the thrust from the propeller via the control surface based upon the spatial relationship of the control surface with respect to the propeller, wherein the redirected thrust comprises a component of non-forward thrust; and adjusting the position of the control surface with respect to the propeller, further comprising disabling control by an operator of the watercraft to move the control surface into the prop wash while the watercraft exceeds a specified speed or the propeller exceeds a revolutions per minute threshold.

23. The method of claim 22, wherein adjusting the position of the control surface with respect to the propeller comprises adjusting a velocity of the watercraft to navigate the watercraft.

24. A method to redirect a thrust generated by a propeller via a control surface for a watercraft, the method comprising:

applying force via a first member to adjust a spatial relationship between the control surface and the propeller to position the control surface at a position at least partially within an area in which prop wash is to be expelled by the propeller, wherein applying the force comprises holding the control surface in the position via a spring coupled with the control surface;

redirecting the thrust from the propeller via the control surface based upon the spatial relationship of the control surface with respect to the propeller, wherein the redirected thrust comprises a component of non-forward thrust; and adjusting the position of the control surface with respect to the propeller by adjusting a length of an adjustable member to rotate the first member to move the control surface between different positions within the area in which prop wash is to be expelled by the propeller to positions not directly within the area in which prop wash is to be expelled by the propeller to generate a net thrust to steer the watercraft.

25. The method of claim 24, wherein adjusting the position of the control surface with respect to the propeller comprises adjusting the position of the control surface to maintain a substantially constant speed.

26. The method of claim 24, wherein adjusting the position of the control surface with respect to the propeller comprises adjusting a distance between the propeller and the control surface.

27. The method of claim 24, wherein adjusting the position of the control surface with respect to the propeller comprises generating a net, non-forward thrust to move the watercraft in a non-forward direction.

28. The method of claim 24, wherein adjusting the position of the control surface with respect to the propeller comprises adjusting an angle of the control surface with respect to the thrust to adjust the magnitude and direction of net thrust.

29. The method of claim 24, wherein applying the force comprises applying pressure to an adjustable arm via a driver system to substantially maintain the control surface in the position.

30. The method of claim 24, wherein redirecting the thrust further comprises releasing the control surface to prevent damage when stresses approach design limits.

31. A method to redirect a thrust generated by a propeller via a control surface for a watercraft, the method comprising:

applying force via a first member to adjust a spatial relationship between the control surface and the propeller to position the control surface at a position at least partially within an area in which prop wash is to be expelled by the propeller;

redirecting the thrust from the propeller via the control surface based upon the spatial relationship of the control surface with respect to the propeller, wherein the redirected thrust comprises a component of non-forward thrust wherein redirecting the thrust comprises generating a net, zero thrust while the control surface is positioned at an angle substantially perpendicular to the prop wash, wherein the net, zero thrust is based upon the position, distance and angle between the control surface and the propeller; and adjusting the position of the control surface with respect to the propeller by adjusting a length of an adjustable member to rotate the first member to move the control surface between different positions within the area in which prop wash is to be expelled by the propeller to positions not directly within the area in which prop wash is to be expelled by the propeller to generate a net thrust to steer the watercraft.

32. The method of claim 31, wherein adjusting the position comprises sensing a change in the tilt or the trim of the watercraft and responsively adjusting the position of the control surface.

33. The method of claim 31, wherein adjusting the control surface with respect to the propeller comprises detecting a speed of the watercraft and adjusting the position of the control surface based upon the speed.

34. The method of claim 31, wherein adjusting the control surface with respect to the propeller comprises determining the position of the control surface to direct the watercraft toward a set of coordinates.

35. The method of claim 31, wherein redirecting the thrust comprises redirecting at least a portion of the thrust in a non-forward direction to steer the watercraft.

36. The method of claim 31, wherein applying force via the first member comprises applying force to adjust the spatial relationship between two distinct control plates of the control surface and the propeller.

37. The method of claim 31, further comprising applying force via a second member to adjust the spatial relationship between a second control surface and the propeller.

38. The method of claim 31, wherein applying force via the first member comprises applying force to adjust the spatial relationship between two distinct control plates of the control surface and the propeller.

39. The method of claim 31, further comprising applying force via a second member to adjust the spatial relationship between a second control surface and the propeller.

40. A watercraft capable of redirecting a thrust generated by a propeller, the watercraft comprising:

a hull having a motor coupled with the propeller to rotate the propeller to expel prop wash to generate the thrust;

a control surface to redirect the thrust from the propeller, based upon a position of the control surface with respect to the propeller, wherein the redirected thrust comprises a component of non-forward thrust, wherein the control surface comprises a first flat surface substantially perpendicular to the thrust and one or more other surfaces operating in conjunction with the first flat surface to redirect the thrust; and a first member to couple with the hull to apply force to adjust a spatial relationship between the control surface and the propeller to position the control surface at least partially within the prop wash, wherein the first member couples with the control surface via a spring.

41. A control system for a watercraft to redirect a thrust generated by a propeller, comprising:

a control surface to redirect the thrust from the propeller based upon a spatial relationship between the control surface and the propeller, wherein the redirected thrust comprises a component of non-forward thrust;

an attachment member coupled with the watercraft to apply force to modify the spatial relationship between the control surface and the propeller to position the control surface at least partially within an area in which prop wash is to be expelled by the propeller;

a driver to transmit the force from the watercraft to the attachment member; and a controller to determine an adjustment for the spatial relationship between the control surface and the propeller and the communication with the driver to implement the adjustment;

wherein the control surface resides in a cavity formed into a hull of the watercraft and is adapted to reflect the thrust while a shaft of an inboard motor is raised to direct the prop wash at least partially into the cavity.

42. A database to redirect a thrust generated by a propeller via a control surface for a watercraft, comprising:

thrust data to relate a current spatial relationship between the control surface and the propeller with a components of a current redirected thrust;

propulsion data to relate the components of the current redirected thrust with a current rotational and spatial velocity and acceleration of the watercraft; and a formula to determine an adjustment to a positional and angular relationship of the current spatial relationship based upon a difference between the current redirected thrust and a new propulsion, the adjustment to position the control surface at least partially within an area in which prop wash is to be expelled by the propeller to effect the new propulsion; wherein the adjustment is indicative of an application of force to implement the adjustment.

43. The database of claim 42, further comprising correction factor data to be utilized via the formula to account for environmental conditions that affect a velocity of the watercraft.

44. The database of claim 42, wherein the formula is adapted to determine adjustments for the current position of the control surface based upon input from a boat operator.

45. The database of claim 42, wherein the formula is adapted to determine adjustments for the current position of the propeller based upon input from a boat operator.

46. A method to redirect a thrust generated by a propeller via a control surface for a watercraft, the method comprising:

applying force via a first member to adjust a spatial relationship between the control surface and the propeller to position the control surface at a position at least partially within an area in which prop wash is to be expelled by the propeller;

redirecting the thrust from the propeller via the control surface based upon the spatial relationship of the control surface with respect to the propeller, wherein the redirected thrust comprises a component of non-forward thrust; and adjusting the position of the propeller to direct at least part of the prop wash to the control surface, wherein applying the force comprises holding the control surface in the position via a spring coupled with the control surface.

47. A method to redirect a thrust generated by a propeller via a control surface for a watercraft, the method comprising:

applying force via a first member to adjust a spatial relationship between the control surface and the propeller to position the control surface at a position at least partially within an area in which prop wash is to be expelled by the propeller;

redirecting the thrust from the propeller via the control surface based upon the spatial relationship of the control surface with respect to the propeller, wherein the redirected thrust comprises a component of non-forward thrust; and adjusting the position of the propeller to direct at least part of the prop wash to the control surface, wherein redirecting the thrust comprises generating a net, zero thrust while the control surface is positioned at an angle substantially perpendicular to the prop wash, wherein the net, zero thrust is based upon the position, distance and angle between the control surface and the propeller.

48. A method to redirect a thrust generated by a propeller via a control surface for a watercraft, the method comprising:

applying force via a first member to adjust a spatial relationship between the control surface and the propeller to position the control surface at a position at least partially within an area in which prop wash is to be expelled by the propeller;

redirecting the thrust from the propeller via the control surface based upon the spatial relationship of the control surface with respect to the propeller, wherein the redirected thrust comprises a component of non-forward thrust; and adjusting the position of the propeller to direct at least part of the prop wash to the control surface, wherein redirecting the thrust further comprises releasing the control surface to prevent damage when stresses approach design limits.

49. An apparatus to redirect a thrust generated by a propeller for a watercraft, comprising:

a control surface to redirect the thrust from the propeller based upon a position of the control surface with respect to the propeller, wherein the redirected thrust comprises a component of non-forward thrust;

a first member to couple with the watercraft to apply force to adjust a spatial relationship between the control surface and the propeller to position the control surface at least partially within an area in which prop wash is to be expelled by the propeller, wherein the first member comprises a rigid member and the apparatus further comprises a non-rigid joint to couple the rigid member with the control surface to restrict movement of the control surface in at least one direction;

a spring coupled between the rigid member and the control surface, wherein the spring is adapted to apply the force to the control surface to maintain the control surface at least partially within the prop wash at least until a magnitude of the thrust reaches a threshold magnitude based upon a loading curve of the spring, which allows the control surface to disengage, wherein the position and size of the control surface sufficiently redirect the thrust generated by the propeller to provide a variable, net reverse thrust responsive to the thrust generated by the propeller, wherein the control surface comprises of a bent edge, wherein the bent edge is a distinct member to be coupled with the control surface via a hinge.

* * * * *